US009841228B2

(12) United States Patent
Dickerson et al.

(10) Patent No.: US 9,841,228 B2
(45) Date of Patent: Dec. 12, 2017

(54) SYSTEM AND METHOD FOR LIQUEFYING A FLUID AND STORING THE LIQUEFIED FLUID

(71) Applicant: KONINKLIJKE PHILIPS N.V., Eindhoven (NL)

(72) Inventors: Brian Edward Dickerson, Canton, GA (US); Jeremy Webster Blair, Atlanta, GA (US); Laurent Brouqueyre, Kennesaw, GA (US); Douglas Adam Whitcher, Atlanta, GA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/857,852

(22) Filed: Sep. 18, 2015

(65) Prior Publication Data

US 2016/0003525 A1 Jan. 7, 2016

Related U.S. Application Data

(63) Continuation of application No. 13/498,403, filed as application No. PCT/IB2010/053888 on Oct. 9, 2009, now abandoned.

(60) Provisional application No. 61/246,558, filed on Sep. 29, 2009.

(51) Int. Cl.
*F25J 1/00* (2006.01)
*F17C 13/00* (2006.01)
(Continued)

(52) U.S. Cl.
CPC ..... *F25J 1/0017* (2013.01); *F17C 3/08* (2013.01); *F25J 1/0261* (2013.01); *F17C 2201/0119* (2013.01); *F17C 2201/032* (2013.01); *F17C 2201/054* (2013.01); *F17C 2201/056* (2013.01); *F17C 2203/0375* (2013.01); *F17C 2203/0391* (2013.01); *F17C 2203/0629* (2013.01);
(Continued)

(58) Field of Classification Search
CPC ..... F25J 1/0017; F25J 1/0257; F25J 1/0261; F25J 2290/62; F17C 3/08; F17C 6/00; F17C 13/006; F17C 2205/0149; F17C 2221/011; F17C 2227/0337; F17C 2227/0339; F17C 2227/0369–2227/0381; F17C 3/085; F17C 2203/0391
USPC ..... 62/45.1, 50.1, 51.1, 51.2
See application file for complete search history.

(56) References Cited

U.S. PATENT DOCUMENTS 2,594,244 A 4/1952 Winternitz
2,895,303 A 7/1959 Streeter
(Continued)

FOREIGN PATENT DOCUMENTS

JP 2003515086 A 4/2003
JP 2004085167 A 3/2004
WO WO0136862 A1 5/2001

*Primary Examiner* — Keith Raymond
(74) *Attorney, Agent, or Firm* — Michael W. Haas

(57) ABSTRACT

A Dewar system is configured to liquefy a flow of fluid, and to store the liquefied fluid. The Dewar system is disposed within a single, portable housing. Disposing the components of the Dewar system within the single housing enables liquefied fluid to be transferred between a heat exchange assembly configured to liquefy fluid and a storage assembly configured to store liquefied fluid in an enhanced manner. In one embodiment, the flow of fluid liquefied and stored by the Dewar system is oxygen (e.g., purified oxygen), nitrogen, and/or some other fluid.

15 Claims, 24 Drawing Sheets

(51) Int. Cl.
*F17C 3/08* (2006.01)
*F25J 1/02* (2006.01)

(52) U.S. Cl.
CPC ..... *F17C 2205/0311* (2013.01); *F17C 2205/0323* (2013.01); *F17C 2209/224* (2013.01); *F17C 2221/011* (2013.01); *F17C 2221/014* (2013.01); *F17C 2223/0153* (2013.01); *F17C 2227/0157* (2013.01); *F17C 2260/033* (2013.01); *F17C 2270/0509* (2013.01); *F25J 2290/62* (2013.01)

(56) References Cited

U.S. PATENT DOCUMENTS 2,909,903 A 10/1959 Zimmermann
3,892,106 A 7/1975 Roubeau
4,211,086 A * 7/1980 Leonard ..... F17C 9/02 128/201.21
4,296,610 A 10/1981 Davis
4,432,216 A * 2/1984 Matsuda ..... F25B 9/10 62/51.1
4,468,935 A 9/1984 Albagnac
6,089,226 A * 7/2000 Gier ..... A41D 13/0053 128/201.21
6,212,904 B1 * 4/2001 Arkharov ..... F25J 3/04278 62/47.1
RE43,398 E * 5/2012 Honkonen ..... B01D 5/0039 128/200.24
2004/0045315 A1 3/2004 Kamoshita
2006/0086099 A1 4/2006 Dickerson
2009/0019886 A1 * 1/2009 Willen ..... F25J 1/0208 62/606

* cited by examiner

SYSTEM AND METHOD FOR LIQUEFYING A FLUID AND STORING THE LIQUEFIED FLUID

CROSS-REFERENCE TO RELATED APPLICATIONS

This patent application is a Continuation of U.S. patent application Ser. No. 13/498,403, filed Mar. 27, 2012, which claims the priority benefit under 35 U.S.C. §371 of international patent application no. PCT/IB2010/053888, filed Aug. 30, 2010, which claims the priority benefit under 35 U.S.C. §119(e) of U.S. Provisional Application No. 61/246,558 filed on Sep. 29, 2009, the contents of which are herein incorporated by reference.

BACKGROUND OF THE INVENTION

1. Field of the Invention

The invention relates to the liquefaction of a fluid, and to storage of the liquefied fluid. In particular, the invention relates to systems that provide for liquefaction and storage in a unified and integrated manner.

2. Description of the Related Art

Systems configured to liquefy fluids such as oxygen, nitrogen, and/or other fluids by reducing the temperature and increasing the pressure of the fluid being liquefied are known. Similarly, systems configured to store liquefied fluids are known. However, these systems are generally configured as separate solutions to separate problems. Consequently, conventional apparatus that have been configured to separately liquefy and store fluids rely on a transfer of fluid from a liquefaction system to a storage system that is inefficient, and is prone to malfunction and failure. Further, implementation of separate systems for liquefaction and storage may inhibit the portability, affordability, and/or usability of such conventional solutions.

SUMMARY OF THE INVENTION

One aspect of this invention relates to a system configured to liquefy a fluid, and to store the liquefied fluid. In one embodiment, the system comprises a housing, a heat exchange assembly, and a fluid storage assembly. The housing is configured to substantially seal the interior of the housing from atmosphere. The heat exchange assembly is disposed within the housing. The heat exchange assembly comprises a fluid conduit that passes from inside the housing to outside the housing, and is configured to receive a flow of fluid in its gaseous state from a fluid flow generator located outside the housing. The heat exchange assembly is configured to liquefy the flow of fluid received into the heat exchange assembly via the fluid conduit. The fluid storage assembly is disposed within the housing. The fluid storage assembly is in fluid communication with the heat exchange assembly, and is configured to store fluid that has been liquefied by the heat exchange assembly.

Another aspect of the invention relates to a method of liquefying a fluid, and storing the liquefied fluid. In one embodiment, the method comprises substantially sealing a cavity from atmosphere; receiving a flow of fluid in a gaseous state into the cavity from outside the cavity through a fluid conduit, wherein the flow of fluid is received into the cavity in a gaseous state; liquefying the flow of fluid received into the cavity via the fluid conduit; directing the liquefied fluid into a reservoir disposed within the cavity; and storing the liquefied fluid within the reservoir.

Yet another aspect of the invention relates to a system configured to liquefy a fluid, and to store the liquefied fluid. In one embodiment, the system comprises means for substantially sealing a cavity from atmosphere; means for receiving a flow of fluid in a gaseous state into the cavity from outside the cavity, wherein the flow of fluid is received into the cavity by the means for receiving in a gaseous state; means for liquefying the flow of fluid received into the cavity, wherein the means for liquefying the flow of fluid is disposed within the cavity; and means storing the liquefied fluid within the cavity.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn in proportion. It is to be expressly understood, however, that the drawings are for the purpose of illustration and description only and are not a limitation of the invention. In addition, it should be appreciated that structural features shown or described in any one embodiment herein can be used in other embodiments as well. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION OF EXEMPLARY EMBODIMENTS

Figure 1:
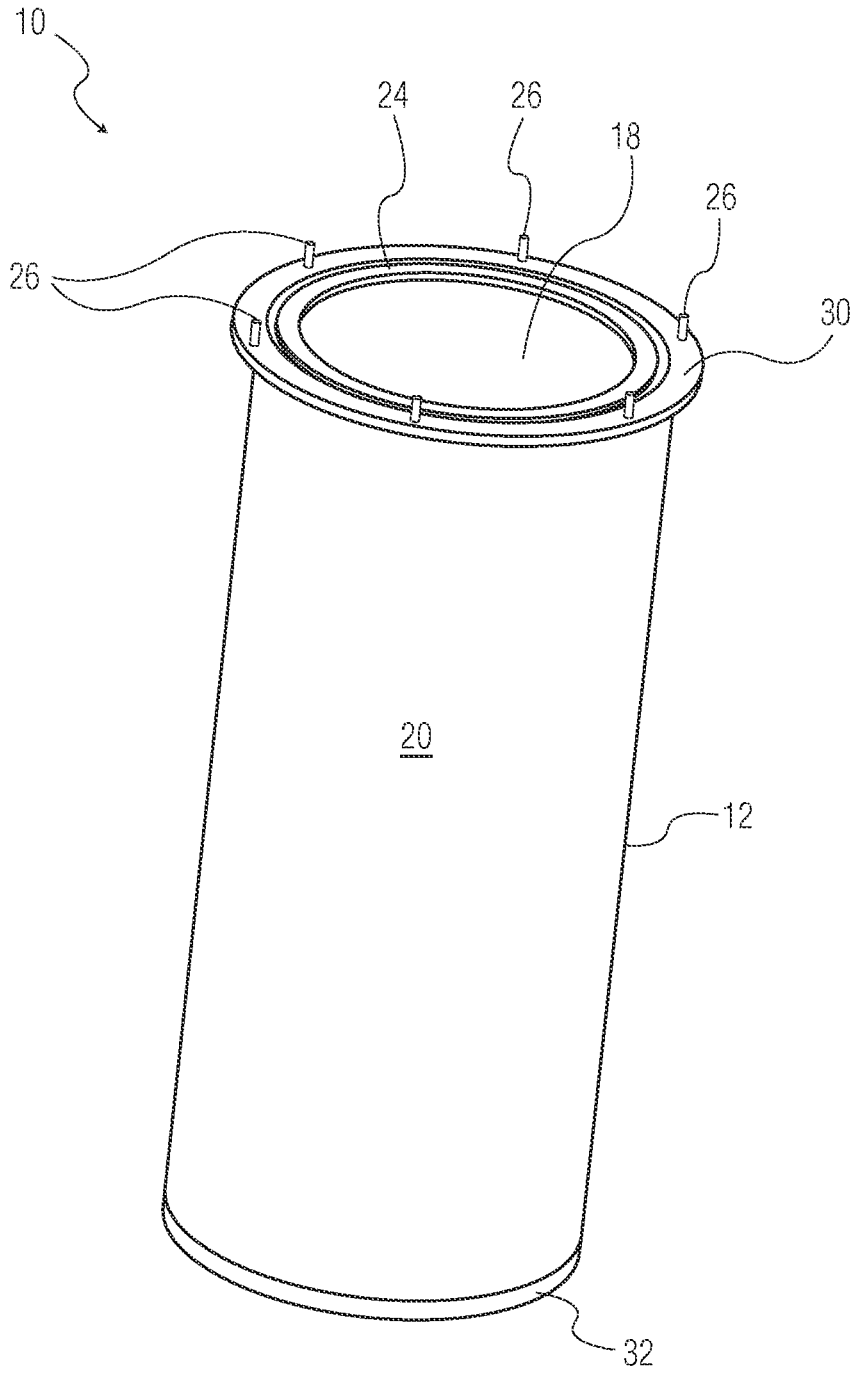
FIG. 1 illustrates a Dewar system configured to liquefy a flow of fluid, and to store the liquefied fluid, in accordance with one or more embodiments of the invention.
Figure 2:
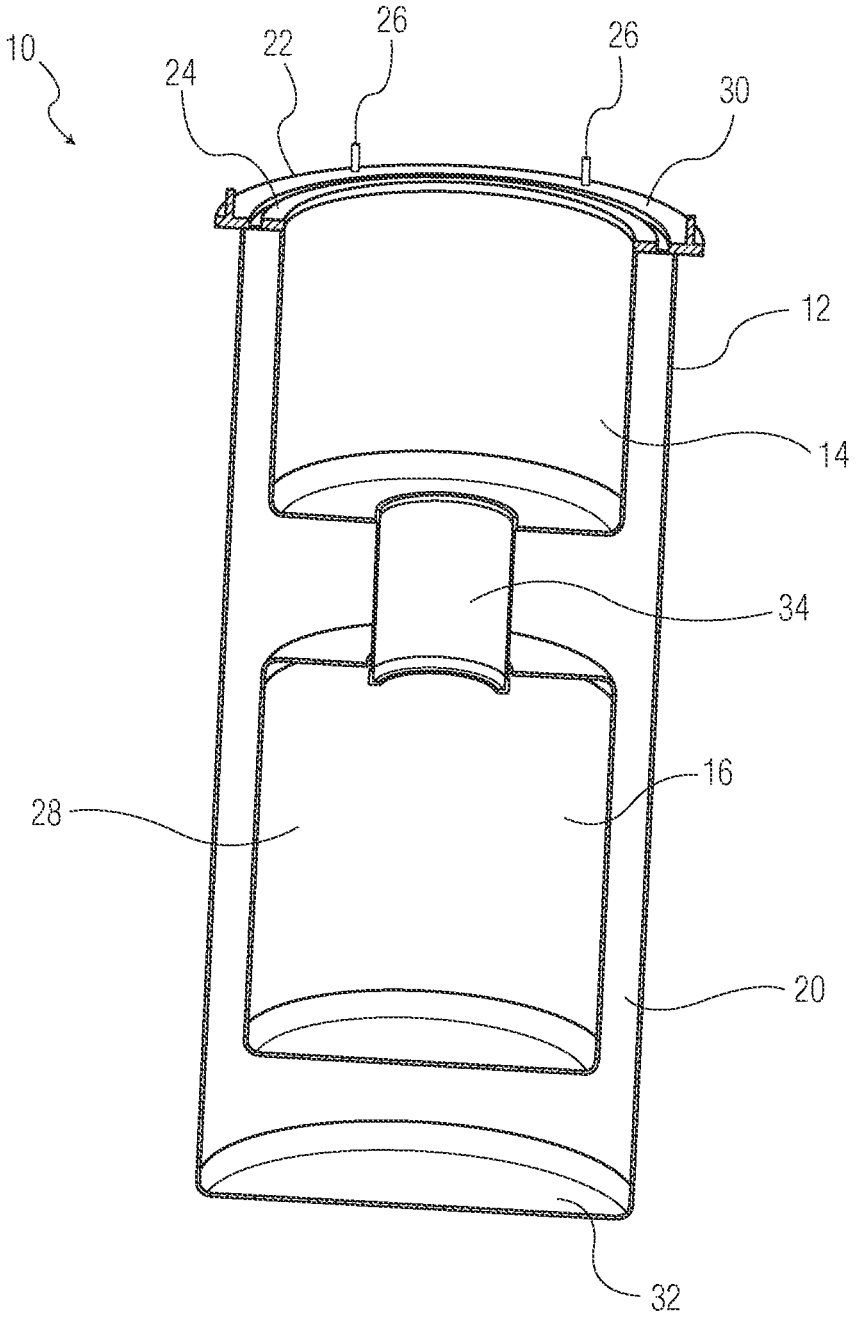
FIG. 2 illustrates a Dewar system configured to liquefy a flow of fluid, and to store the liquefied fluid, in accordance with one or more embodiments of the invention.

FIGS. 1 and 2 illustrate a Dewar system 10 configured to liquefy a flow of fluid, and to store the liquefied fluid. The Dewar system 10 is disposed within a single, portable housing 12. Disposing the components of Dewar system 10 within the single housing 12 enables liquefied fluid to be transferred between a heat exchange assembly 14 configured to liquefy fluid and a storage assembly 16 configured to store liquefied fluid in an enhanced manner. For example, by virtue of enclosing heat exchange assembly 14 and storage assembly 16 within housing 12, the fluid is transferred between heat exchange assembly 14 and storage assembly 16 without implementing a conduit or line that must be individually insulated against ambient atmosphere. As another example, the enclosure of heat exchange assembly 14 and storage assembly 16 within housing 12 may enhance the portability and/or usability of Dewar system 10. In one embodiment, the flow of fluid liquefied and stored by Dewar system 10 is oxygen (e.g., purified oxygen), nitrogen, and/or some other fluid.

Housing 12 is configured to substantially seal the interior of housing 12 from atmosphere. As such, the interior of housing 12 forms a cavity 18 that is substantially sealed from ambient atmosphere. This provides some isolation from ambient atmosphere for components of Dewar system 10 that are disposed within cavity 18 of housing 12. To enhance this isolation, housing 12 may be formed from an insulating material. By way of non-limiting example, housing 12 may be formed from stainless steel, and/or other materials. To further insulate heat exchange assembly 14 and storage assembly 16 from atmosphere, in one embodiment, housing 12 may be evacuated between housing 12 and the portions of cavity 18 within which heat exchange assembly 14 and/or storage assembly 16 are disposed. The created vacuum may provide an enhanced layer of insulation and/or protection for heat exchange assembly 14 and/or storage assembly 16. In addition to providing insulation, housing 12 also provides structural protection for components disposed therein. As such, housing 12 is rigid to resist breakage caused by drops, collisions, and/or other forces experienced by Dewar system 10. Additionally, insulation wrap (not shown) may be used to coat the interior of housing 12 and/or component contained therein as an added one or more layers radiation barrier.

In one embodiment, housing 12 is formed from a first piece 20 and a second piece 22. First piece 20 forms cavity 18 of housing 12 such that cavity 18 has an opening formed by a rim 24. Second piece 22 is a lid, that is selectably coupled to first piece 20 at rim 24 of cavity 18 to substantially seal cavity 18 from atmosphere. The selectable coupling between first piece 20 and second piece 22 may be accomplished via releasable fasteners 26 (e.g., bolts and nuts), as shown in FIGS. 1 and 2. In other embodiments, alternative mechanisms for selectably coupling first piece 20 with second piece 22 may be implemented. For example, first piece 20 may be selectably coupled with second piece 22 via releasable catches and/or latches, a threaded fit, a friction fit, a press fit, a snap fit, a detent mechanism, and/or other mechanisms for selectably coupling components. Although in the embodiment illustrated in FIGS. 1 and 2 first piece 20 and second piece 22 can be completely decoupled from each other, this is not intended to be limiting. Instead, first piece 20 and second piece 22 may be coupled with each other in a non-removable manner at one or more locations. For example, first piece 20 and second piece 22 may be coupled at one or more locations via hinge such that first piece 20 can be second piece 22 partially decoupled and pivoted away from each other to expose cavity 18 of housing 12 to atmosphere. In one embodiment, first piece 20 and second piece 22 are coupled in a non-removable manner (e.g., welded).

Heat exchange assembly 14 is configured to receive a flow of fluid in a gaseous state, and to liquefy the received flow of fluid. Heat exchange assembly 14 receives the flow of fluid from a source of fluid (not shown) that is external to housing 12. The source of fluid may include, for example, a fluid flow generator (e.g., a pressure swing adsorption generator), a storage canister, a wall gas connection, and/or other sources of fluid.

Heat exchange assembly 14 is configured to liquefy the flow of fluid by lowering the temperature of the fluid. This may include supercooling the fluid down to temperatures of about 100° K. or less at 1 atmosphere. As is discussed below, in one embodiment, heat exchange assembly 14 operates by circulation of compressor cooled refrigerant. However, this is not intended to be limiting, and other types of heat exchange system may be disposed (in whole or in part) within housing 12 to liquefy the flow of fluid. For example, some other type of super-cooled fluid could be circulated within heat exchange assembly 14 rather than compressor cooled refrigerant (e.g., liquid nitrogen).

Storage assembly 16 is configured to store fluid that has been liquefied by heat exchange assembly 14. In one embodiment, storage assembly 16 includes a storage reservoir 28. Storage reservoir 28 is in fluid communication with heat exchange assembly 14 such that fluid that has been liquefied by heat exchange assembly 14 is directed into storage reservoir 28. The liquefied fluid is then held within storage reservoir 28 until it is needed. As the liquefied fluid is stored within storage reservoir 28, the temperature within storage reservoir 28 may rise to the point where some of the fluid begins to boil off back into the gaseous state. At least some of this boiled off fluid may be vented from housing 12 to maintain the pressure within storage reservoir 28 at a manageable level.

In one embodiment, housing 12 is formed as a cylinder. This embodiment of housing 12 has a top 30 formed by second piece 22, and a bottom 32 formed by first piece 20. When housing 12 is seated on bottom 32 in the embodiment shown in FIGS. 1 and 2, heat exchange assembly 14 and storage assembly 16 are disposed within housing 12 in a vertical configuration with heat exchange assembly 14 positioned above storage assembly 16.

In one embodiment, storage assembly 16 is formed integrally or securely with first piece 20. As used herein, the formation of storage assembly 16 integrally or securely with first piece 20 refers to a construction of storage assembly 16 and first piece 20 such that these two components are not intended to be separated during regular usage and/or maintenance. While separation of storage assembly 16 and first piece 20 may be achieved, reference to the secure and/or integral attachment between these components reflects the relative strength and permanence of this attachment during typical usage.

In one embodiment, heat exchange assembly 14 is formed integrally or securely with second piece 22. As used herein, the formation of heat exchange assembly 14 integrally or securely with second piece 22 refers to a construction of heat exchange assembly 14 and second piece 22 such that these two components are not intended to be separated during regular usage and/or maintenance. While separation of heat exchange assembly 14 and second piece 22 may be achieved, reference to the secure and/or integral attachment between these components reflects the relative strength and permanence of this attachment during typical usage.

By virtue of the integral and secure formations of storage assembly 16 with first piece 20 and of heat exchange assembly 14 with second piece 22 in the embodiment illustrated in FIGS. 1 and 2, decoupling first piece 20 and second piece 22, and removing second piece 22 from first piece 20 results in heat exchange assembly 14 being withdrawn from cavity 18 of housing 12. However, this decoupling leaves storage assembly 16 within cavity 18. As such, an interface assembly 34 that places heat exchange assembly 14 in fluid communication with storage assembly 16 enables heat exchange assembly 14 to be selectably released from fluid communication storage assembly 16 when second piece 22 of housing 12 is decoupled from first piece 20 of housing 12.

Figure 3:
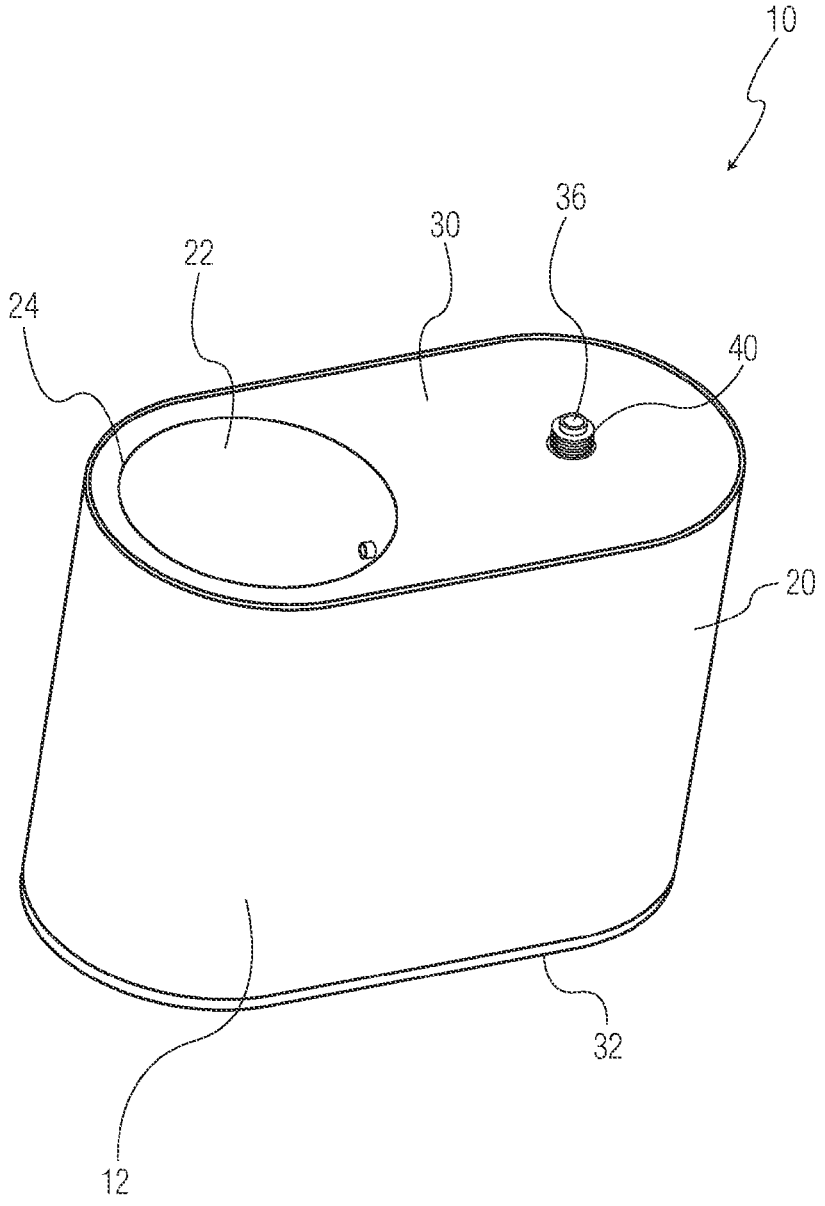
FIG. 3 illustrates a Dewar system configured to liquefy a flow of fluid, and to store the liquefied fluid, in accordance with one or more embodiments of the invention.
Figure 4:
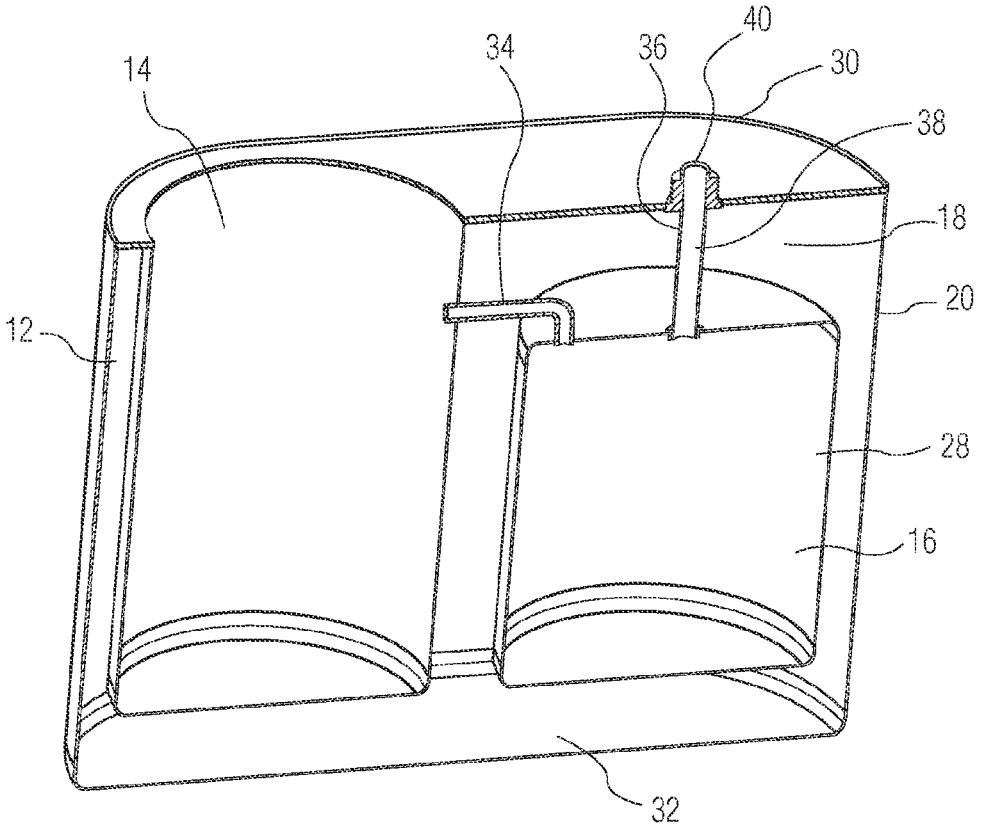
FIG. 4 illustrates a Dewar system configured to liquefy a flow of fluid, and to store the liquefied fluid, in accordance with one or more embodiments of the invention.

FIGS. 3 and 4 illustrate one or more embodiments of Dewar system 10 in which when housing 12 is seated on bottom 32, heat exchange assembly 14 and storage assembly 16 are located side by side within housing 12 (rather than one on top of the other). In the one or more embodiments depicted in FIGS. 3 and 4, second piece 22 of housing 12 is disposed over heat exchange assembly 14 so that heat exchange assembly 14 can be formed integrally and securely with heat exchange assembly 14.

In the view of Dewar system 10 shown in FIG. 4, a fluid outlet 36 provides selective fluid communication between storage assembly 16 and the exterior of housing 12. Fluid outlet 36 enables fluid stored within storage assembly 16 to be released from storage reservoir 28 for pressure maintenance within storage reservoir 28 and/or for use. Fluid outlet 36 includes an outlet conduit 38 and an outlet valve 40. Outlet conduit 38 conveys fluid from within storage reservoir 28 to the exterior of housing 12. Outlet valve 40 is configured to selectably seal the outlet conduit 38 such that the fluid from storage reservoir 28 can be released from storage reservoir 28 in a controllable manner. In one embodiment, rather than outlet valve 40, fluid outlet 36 may include an interface (e.g., a threaded component, a component with a detent mechanism, etc.) that enables interface assembly 34 to be securely interfaced with a valve assembly that controls the release of fluid from storage reservoir 28. Fluid outlet 36 may be configured to release fluid from storage reservoir 28 in the gaseous state (e.g., for pressure maintenance) and/or in the liquid state (e.g., for use).

Figure 5:
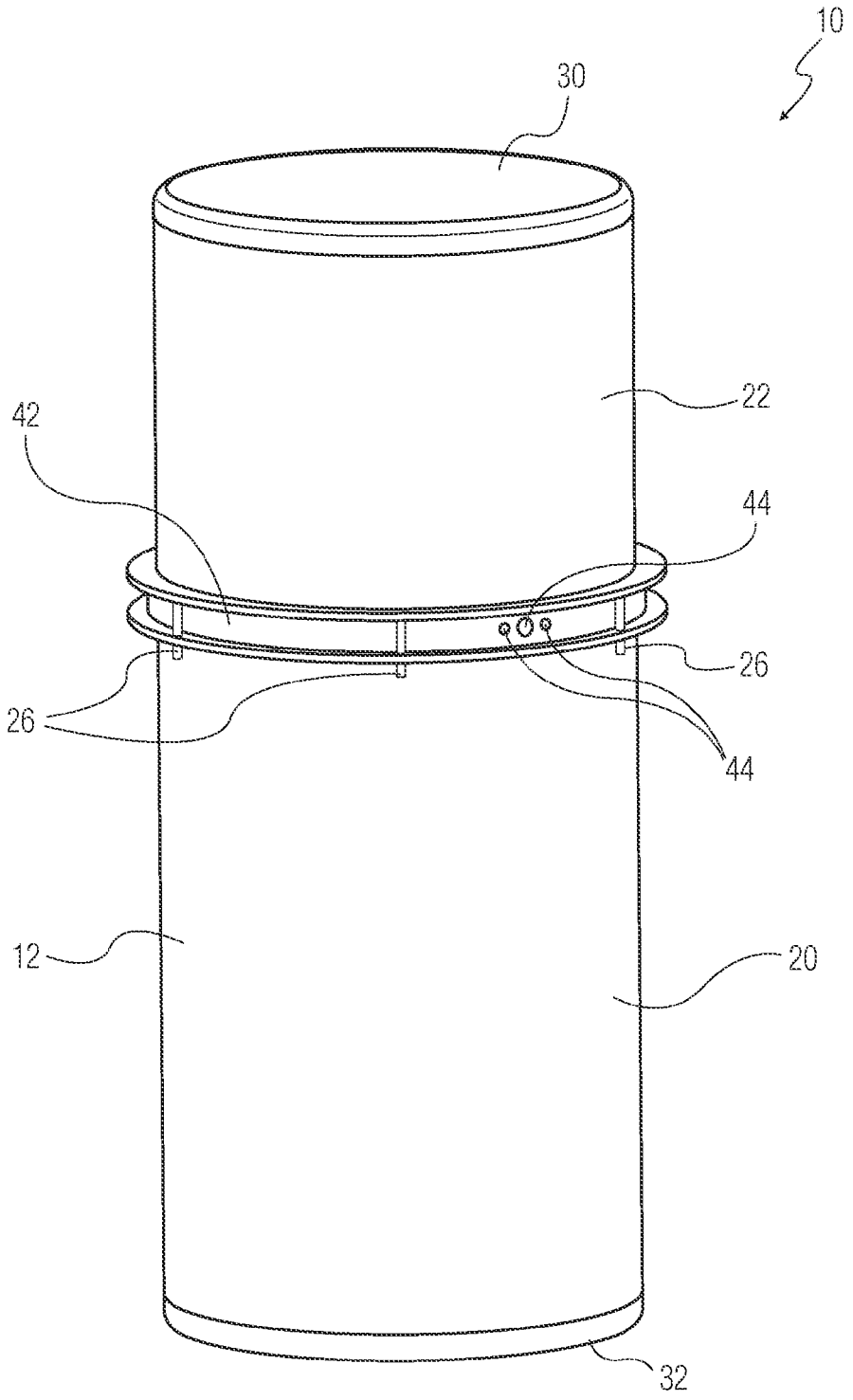
FIG. 5 illustrates a Dewar system configured to liquefy a flow of fluid, and to store the liquefied fluid, in accordance with one or more embodiments of the invention.
Figure 6:
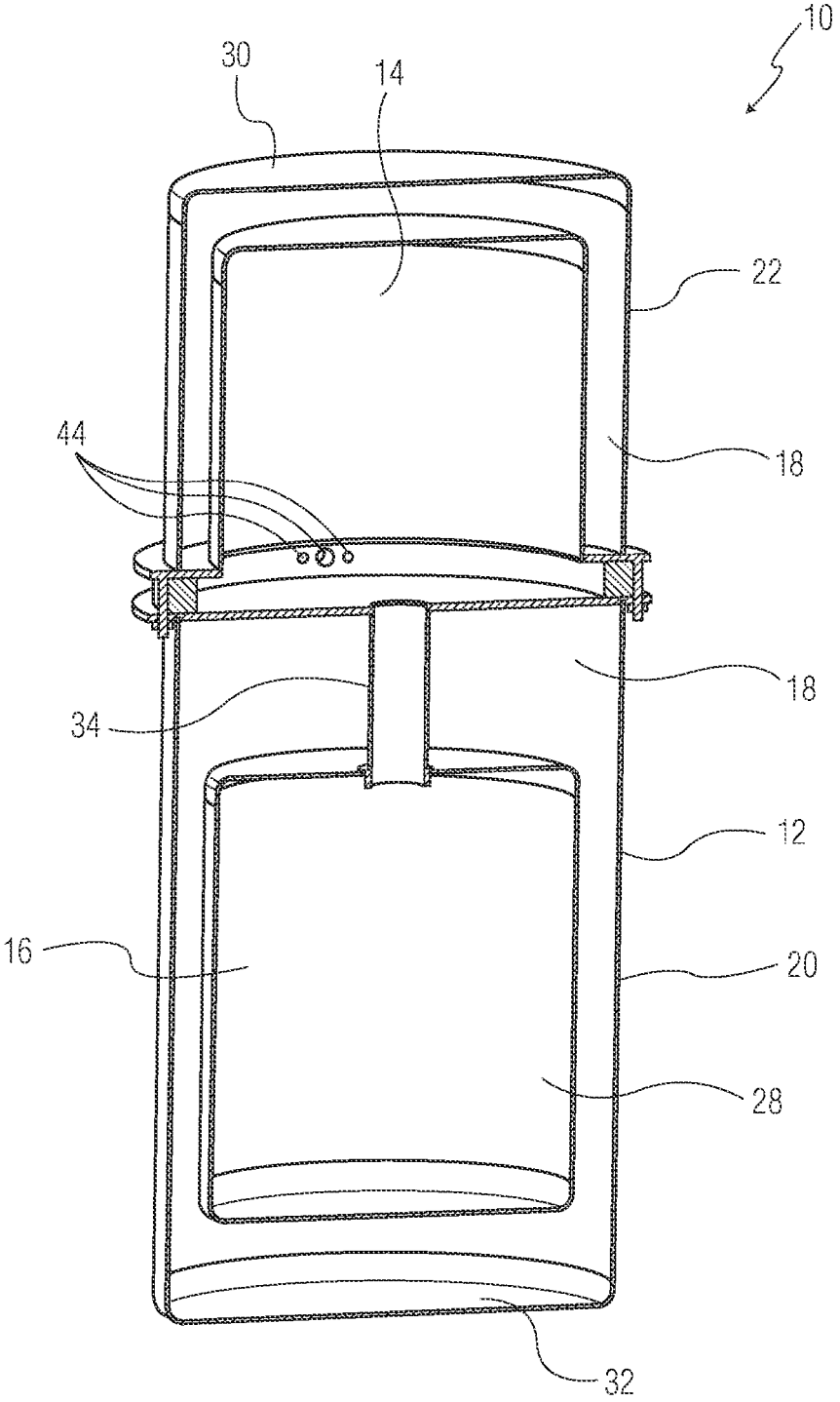
FIG. 6 illustrates a Dewar system configured to liquefy a flow of fluid, and to store the liquefied fluid, in accordance with one or more embodiments of the invention.

FIGS. 5 and 6 illustrate one or more embodiments of Dewar system 10. In the embodiments illustrated in FIGS. 5 and 6, second piece 22 is not formed as a substantially flat lid that is selectably coupled to rim 24 of first piece 20. Instead, second piece 22 itself forms a portion of cavity 18 of housing 12. As can be seen in FIGS. 5 and 6, heat exchange assembly 14 is nested inside of the portion of cavity 18 formed by second piece 22, while storage assembly 16 is nested inside of the portion of cavity 18 formed by first piece 20.

In one embodiment, a gasket 42 is disposed between first piece 20 and second piece 22. One or more openings 44 are formed in gasket 42. Through the one or more openings 44, the components of Dewar system 10 housed within housing 12 communicate with the exterior of housing 12. For example, fluid from a fluid source may be communicated to heat exchange assembly 14 through an opening 44, fluid stored within storage reservoir 28 may be communicated to the exterior of the housing through an opening 44, and/or other components of Dewar system 10 within housing 12 may be communicated with the exterior of housing 12 through the one or more openings 44.

Figure 7:
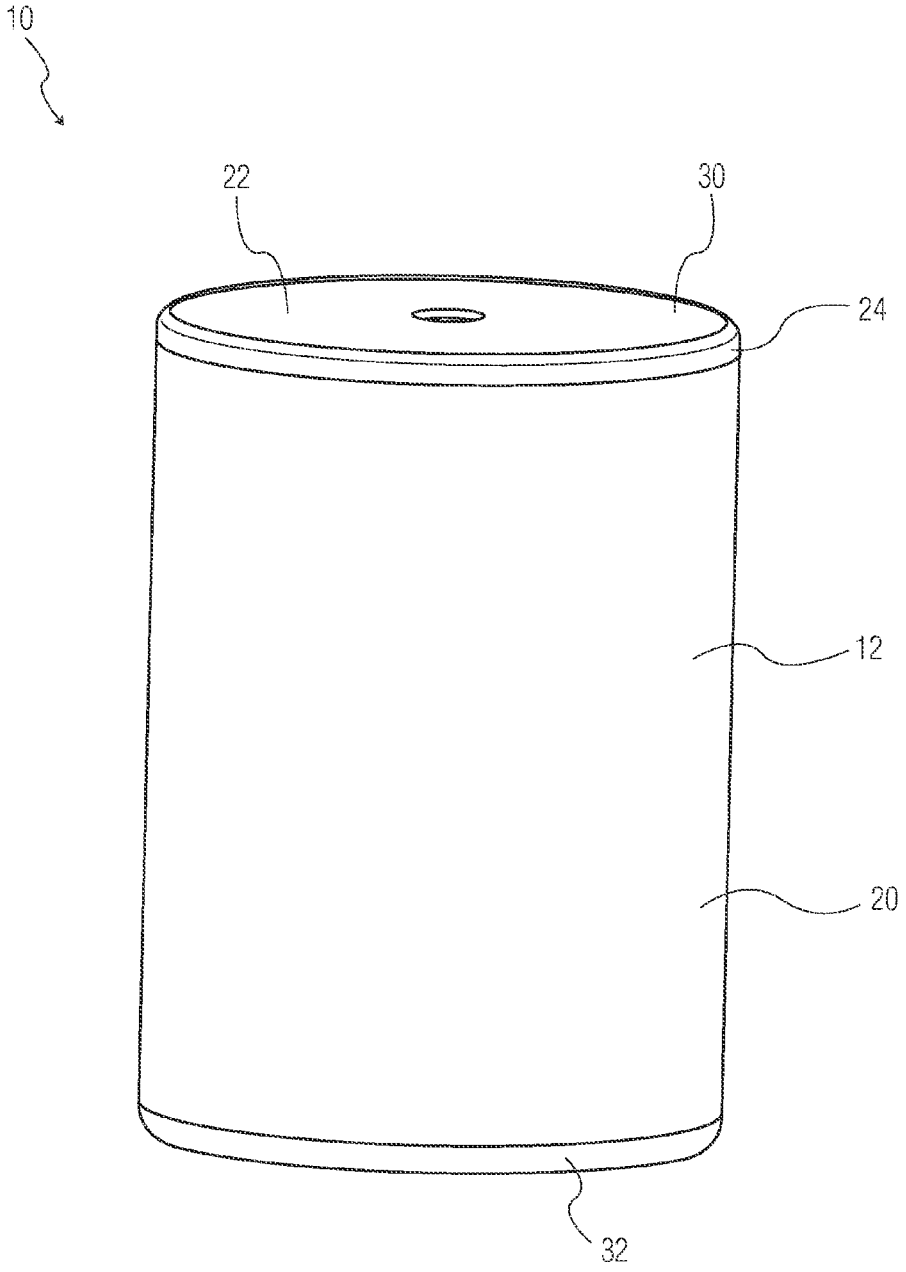
FIG. 7 illustrates a Dewar system configured to liquefy a flow of fluid, and to store the liquefied fluid, in accordance with one or more embodiments of the invention.
Figure 8:
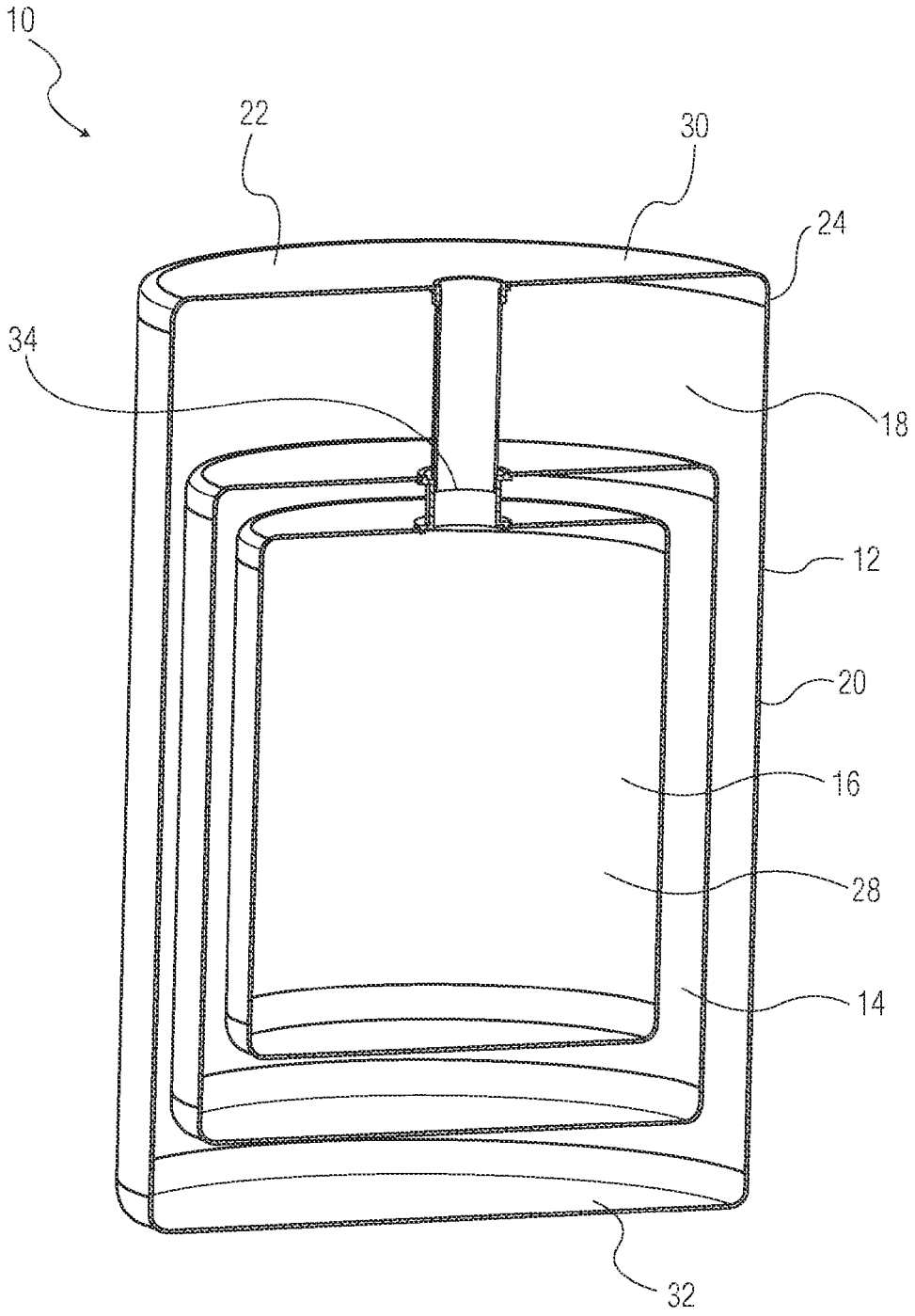
FIG. 8 illustrates a Dewar system configured to liquefy a flow of fluid, and to store the liquefied fluid, in accordance with one or more embodiments of the invention.

FIGS. 7 and 8 illustrate one or more embodiments of Dewar system 10. In the embodiments illustrated in FIGS. 7 and 8, storage assembly 16 is disposed within heat exchange assembly 14. In the depiction of Dewar system 10 shown in FIGS. 7 and 8, storage assembly 16 is shown as being positioned entirely within heat exchange assembly 14. This is not intended to be limiting. In one embodiment, heat exchange assembly 14 only partially surrounds storage assembly 16.

Figure 9:
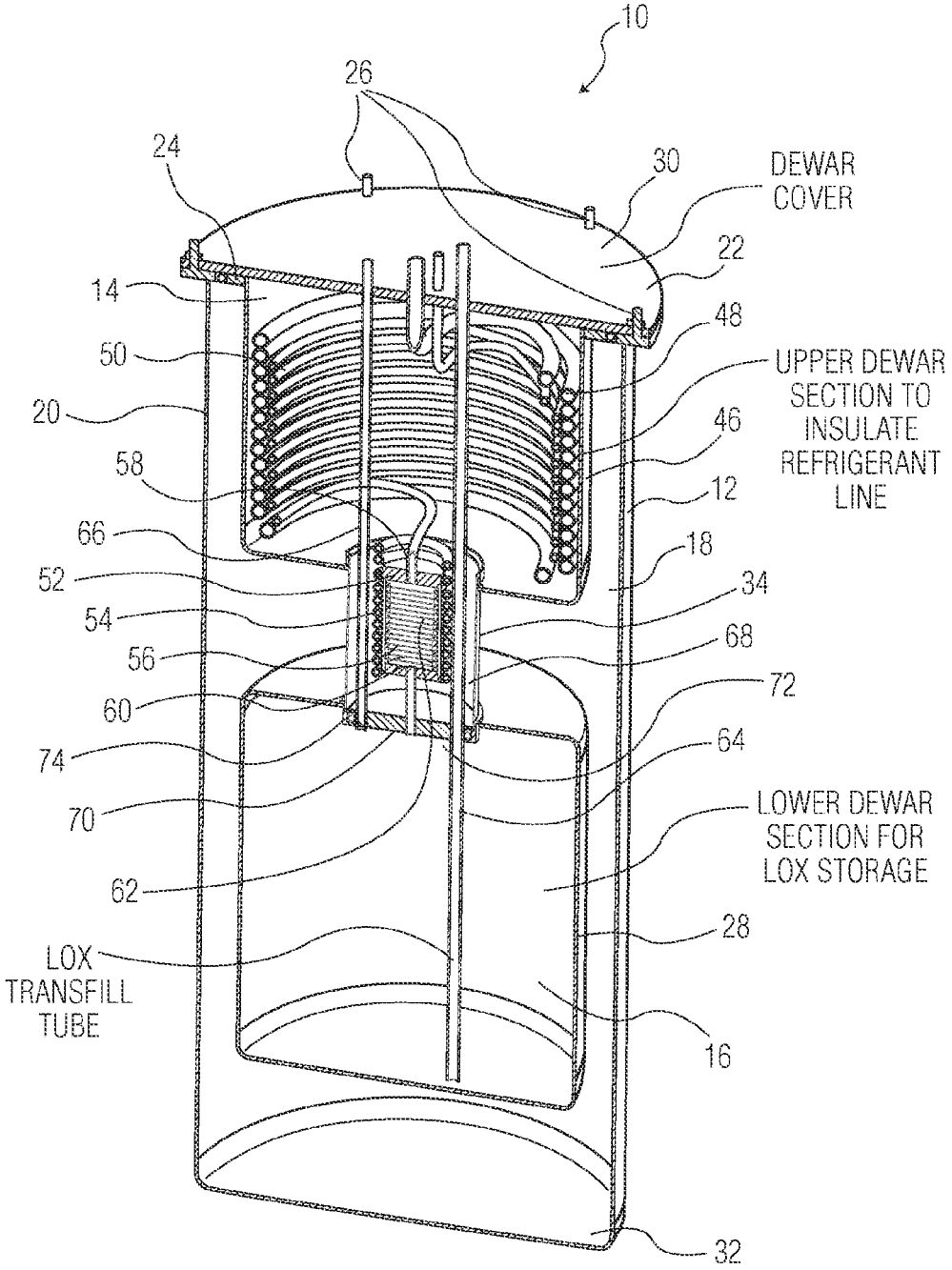
FIG. 9 illustrates a Dewar system configured to liquefy a flow of fluid, and to store the liquefied fluid, in accordance with one or more embodiments of the invention.

FIGS. 9-13 illustrate one or more embodiments of Dewar system 10 in which heat exchange assembly 14 is positioned on top of storage assembly 16 in the manner shown in FIGS. 1 and 2. Turning specifically to FIG. 9, heat exchange assembly 14 is shown as being encased by a heat exchange housing 46 disposed within housing 12. Housing 46 houses heat exchange assembly 14 within cavity 18. Housing 46 provides another layer of insulation between heat exchange assembly 14 and ambient atmosphere, and creates a pocket of gas (or of vacuum) between housing 12 and housing 46 that further insulates heat exchange assembly 14.

In one embodiment, heat exchange assembly 14 includes a refrigerant conduit 48. Refrigerant conduit 48 passes through housing 12 (e.g., at second piece 22) to communicate heat exchange assembly 14 with the exterior of housing 12. Refrigerant conduit 48 is configured to receive and circulate a flow of cooled refrigerant. The flow of cooled refrigerant may be received, for example, from a compressor (not shown) that cools the refrigerant, and is located outside of housing 12. Upon passing through the length of refrigerant conduit 48, the refrigerant may be conveyed out of housing 12 by refrigerant conduit 48 (e.g., back to the compressor for further cooling and re-circulation). In one embodiment, refrigerant conduit 48 may be arranged in a coil, or some other labyrinthine configuration designed to minimize the volume of heat exchange assembly 14 as a whole while increasing the length of refrigerant conduit 48 included therein.

As can be seen in FIG. 9, in one embodiment, heat exchange assembly 14 includes a fluid conduit 50 disposed in thermal communication with heat exchange assembly 14. In one embodiment, fluid conduit 50 is disposed next to and/or in contact with refrigerant conduit 48 such that refrigerant conduit 48 forms a heat sink along the length of fluid conduit 50. Fluid conduit 50 passes through housing 12 (e.g., at second piece 22) to communicate with the exterior of housing 12. The fluid conduit is configured to receive a flow of fluid in a gaseous state from a fluid source. The received flow of fluid is directed through fluid conduit 50. As the flow of fluid passes through fluid conduit 50, heat is removed from the fluid by refrigerant conduit 48. This reduces the temperature of the flow of fluid to the point that the fluid is transformed from the gaseous state to a liquid state. The removal of heat from the fluid within fluid conduit 50 may reduce the temperature of the flow of fluid to a super-cooled level.

In one embodiment, heat exchange assembly 14 includes a cold head 52. After directing the flow of fluid along the length of 48, fluid conduit 50 may provide the flow of fluid into cold head 52. Cold head 52 is configured to further reduce the temperature of the flow of fluid such that any fluid not liquefied within fluid conduit 50 is liquefied in cold head 52. In one embodiment illustrated in FIG. 9, cold head 52 includes a secondary refrigerant conduit 54 and a condensing chamber 56.

Secondary refrigerant conduit 54 is configured to receive cooled refrigerant (e.g., from refrigerant conduit 48, from an external source, etc.), and to circulate the refrigerant. Secondary refrigerant conduit 54 is in thermal communication with cold head 52. In one embodiment, secondary refrigerant conduit 54 is disposed around the outside of cold head 52 to provide a heat sink for cold head 52.

Condensing chamber 56 is formed by the body of cold head 52. The condensing chamber includes a fluid inlet 58 and a fluid outlet 60. Fluid inlet 58 communicates with fluid conduit 50 to receive cooled and at least partially liquefied fluid therefrom. Fluid outlet 60 communicates with storage reservoir 28 to provide liquefied fluid thereto for storage. In one embodiment, one or more coalescing structures 62 are formed within condensing chamber 56. Coalescing structures 62 are configured to form super-cooled surfaces on which fluid that has not yet been liquefied can be condensed. Coalescing structures 62 are cooled by the heat sink provided to cold head 52 by secondary refrigerant conduit 54. In one embodiment, condensing chamber 56 is formed from a thermally conductive material, such as copper, aluminum, or other materials, that enhance the removal of heat from coalescing structures 62 by secondary refrigerant conduit 54.

During operation, fluid that is at least partially liquefied is introduced into cold head 52 through fluid inlet 58, and migrates toward fluid outlet 60. As the fluid passes through condensing chamber 56 from fluid inlet 58 to fluid outlet 60, fluid that has not been liquefied becomes condensed on coalescing structures 62. Thus, fluid provided to storage reservoir 28 for storage and/or usage from cold head 52 is substantially completely liquefied.

FIG. 9 further illustrates a transfill tube 64, and a fluid vent 66. Transfill tube 64 is configured to communicate liquefied fluid in storage reservoir 28 with the exterior of housing 12 (e.g., for usage). Fluid vent 66 is configured to enable fluid stored within storage reservoir 28 to be vented. For example, elevated pressures within storage reservoir 28 caused by liquefied fluid stored in storage reservoir 28 boiling off can be regulated by selectively venting fluid in the gaseous state (after boil-off) from storage reservoir 28 through fluid vent 66.

As can be seen in FIG. 9, in one embodiment, interface assembly 34 includes a reservoir neck 68 and a reservoir lid 70. Reservoir neck 68 is provided at an opening in storage reservoir 28 of storage assembly 16 that faces toward heat exchange assembly 14. Reservoir neck 68 has a generally cylindrical shape. When Dewar system 10 is assembled and operational, reservoir neck 68 is removably seated in an opening 72 formed in housing 46 at an end of reservoir neck 68 opposite from storage reservoir 28. In one embodiment illustrated in FIG. 9, cold head 52 is configured to be disposed inside of reservoir neck 68 when Dewar system 10 is assembled and operational.

Figure 10:
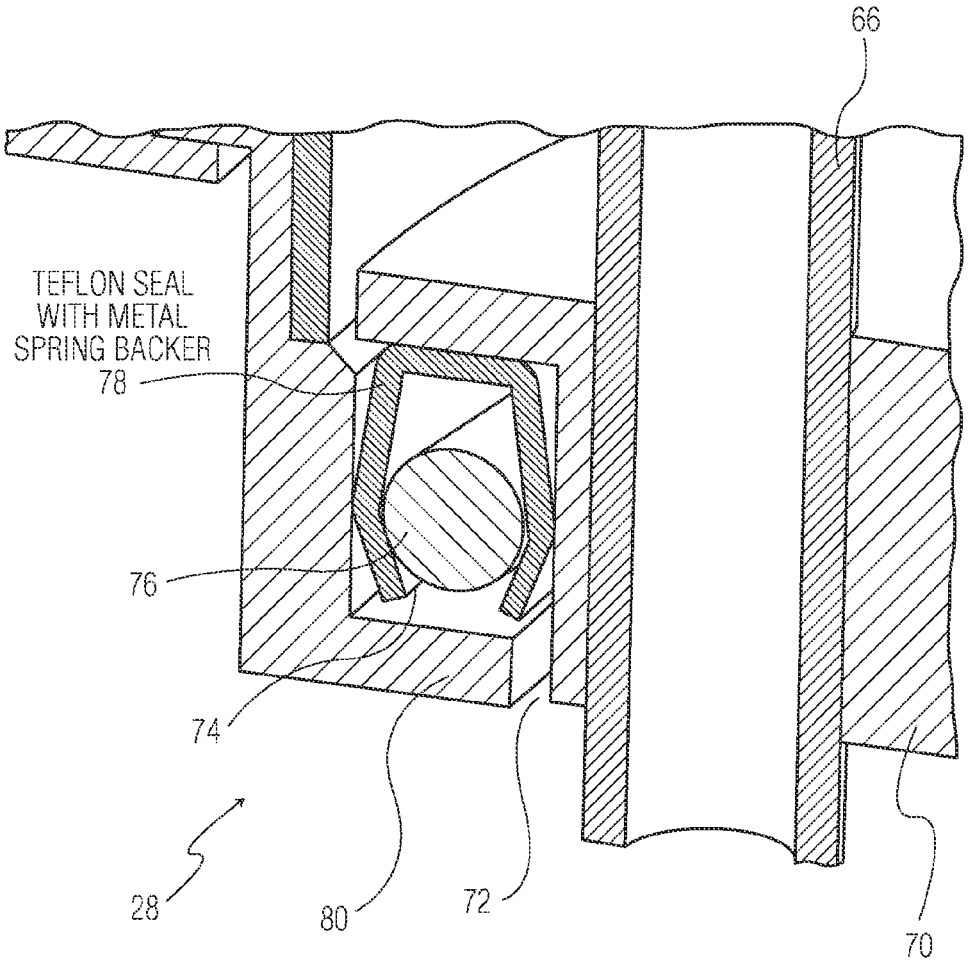
FIG. 10 illustrates a seal implemented within a Dewar system to seal an interface assembly from a storage assembly, according to one or more embodiments of the invention.

Reservoir lid 70 is configured to fill the opening in storage reservoir 28 by reservoir neck 68, thereby enclosing storage reservoir 28. In one embodiment, reservoir lid 70 seals storage reservoir 28. For example, FIG. 10 provides a magnified view of a seal 74 that is carried by reservoir lid 70. Seal 74 includes an o-ring 76 and a spring backer 78 that retains o-ring 76 in place on reservoir lid 70. When Dewar system 10 is assembled and operational, o-ring 76 contacts a lip 80 formed at the opening of storage reservoir 28 to seal storage reservoir 28.

Figure 11:
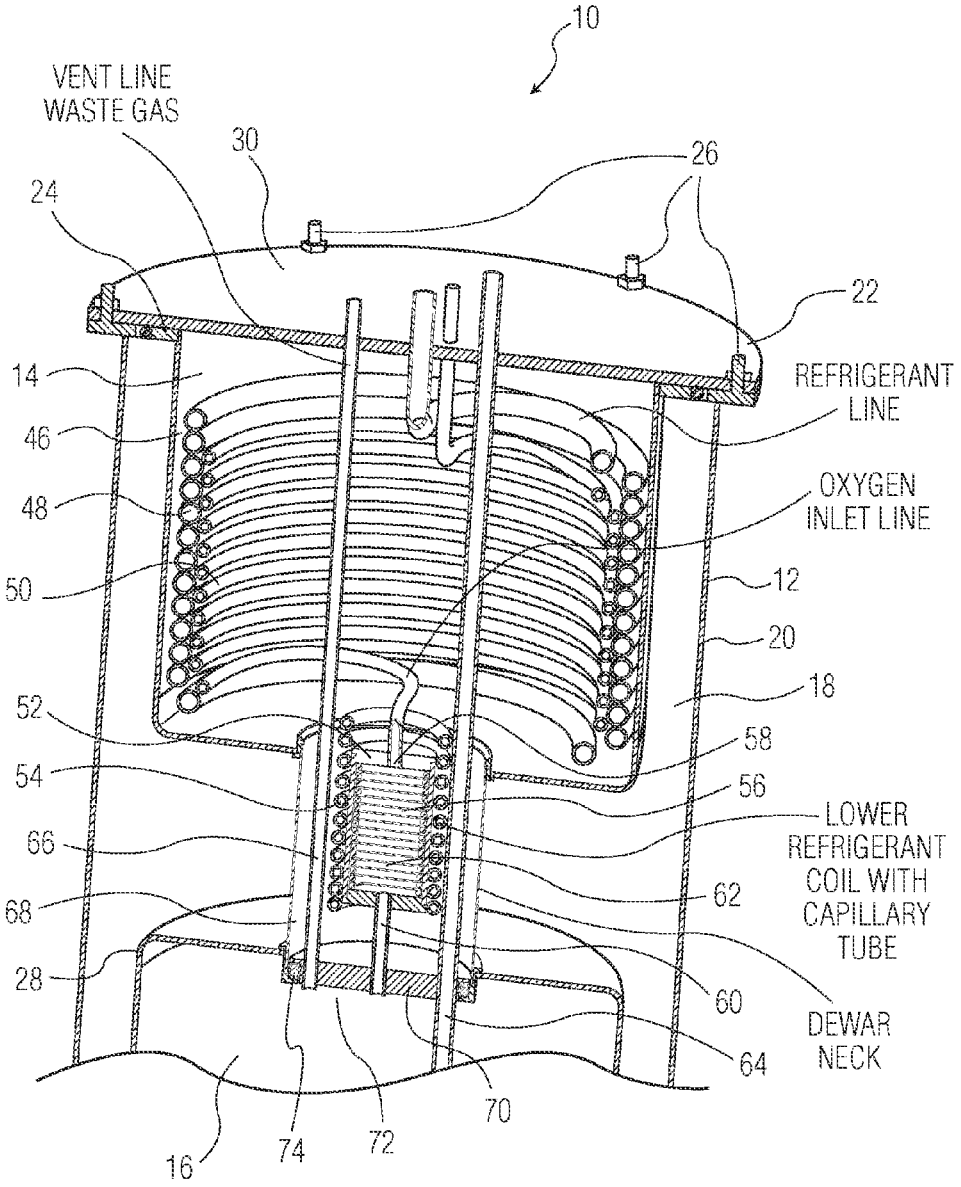
FIG. 11 illustrates a heat exchange assembly and an interface assembly in a Dewar system configured to liquefy a flow of fluid, and to store the liquefied fluid, according to one or more embodiments of the invention.
Figure 12:
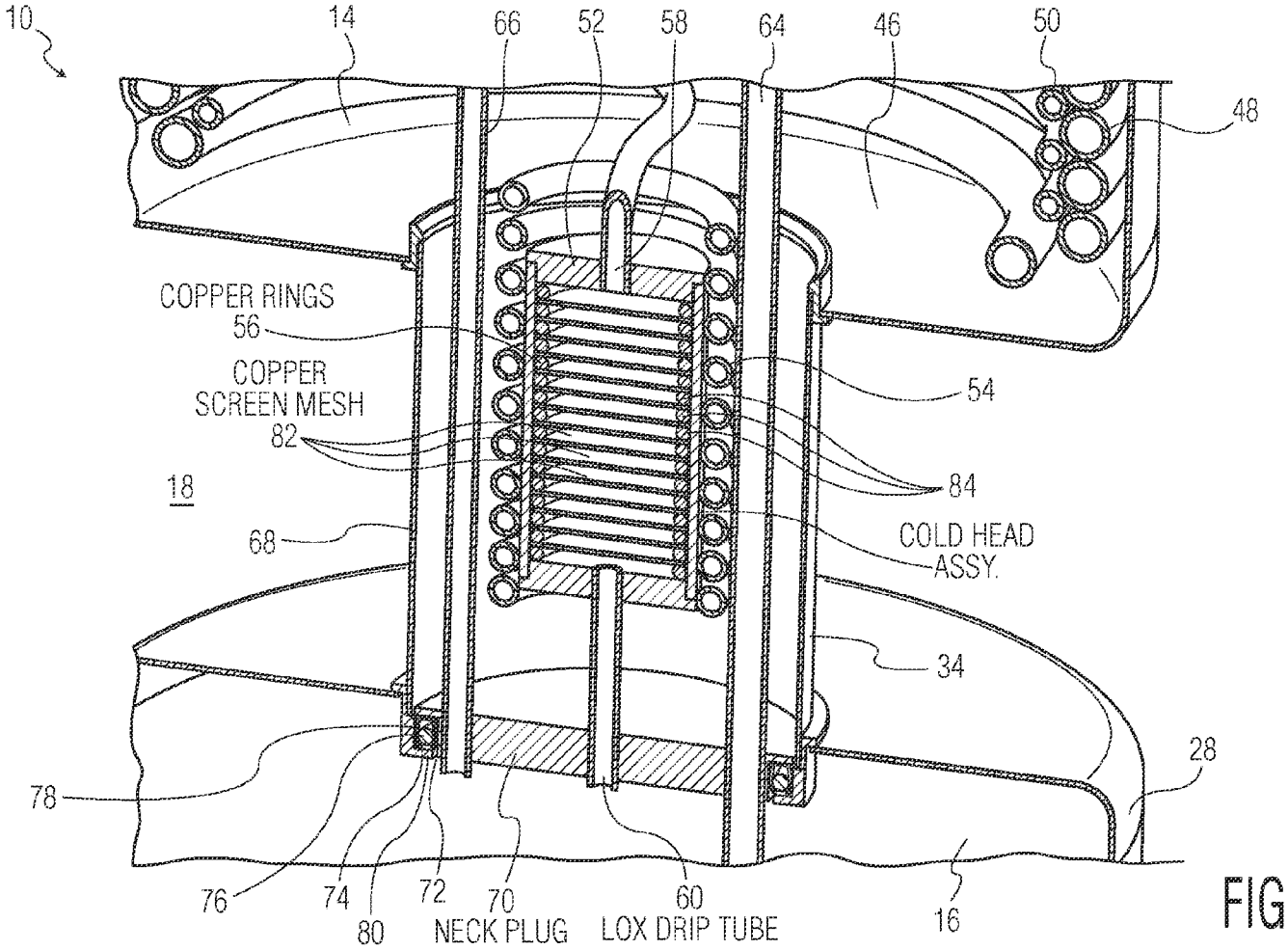
FIG. 12 illustrates a an interface assembly in a Dewar system configured to liquefy a flow of fluid, and to store the liquefied fluid, according to one or more embodiments of the invention.

FIGS. 11 and 12 provide magnified views of heat exchange assembly 14 and interface assembly 34 together, and interface assembly 34 alone, respectively. As can be seen in these magnified views, in one embodiment, coalescing structures 62 formed within cold head 52 include a plurality of screen meshes 82 separated by spacers 84. Screen meshes 82 and/or spacers 84 may be formed from thermally conductive materials, such as copper, aluminum, or other materials, to enhance the removal of heat from coalescing structures 62 by secondary refrigerant conduit 54 through thermal conduction.

Figure 13:
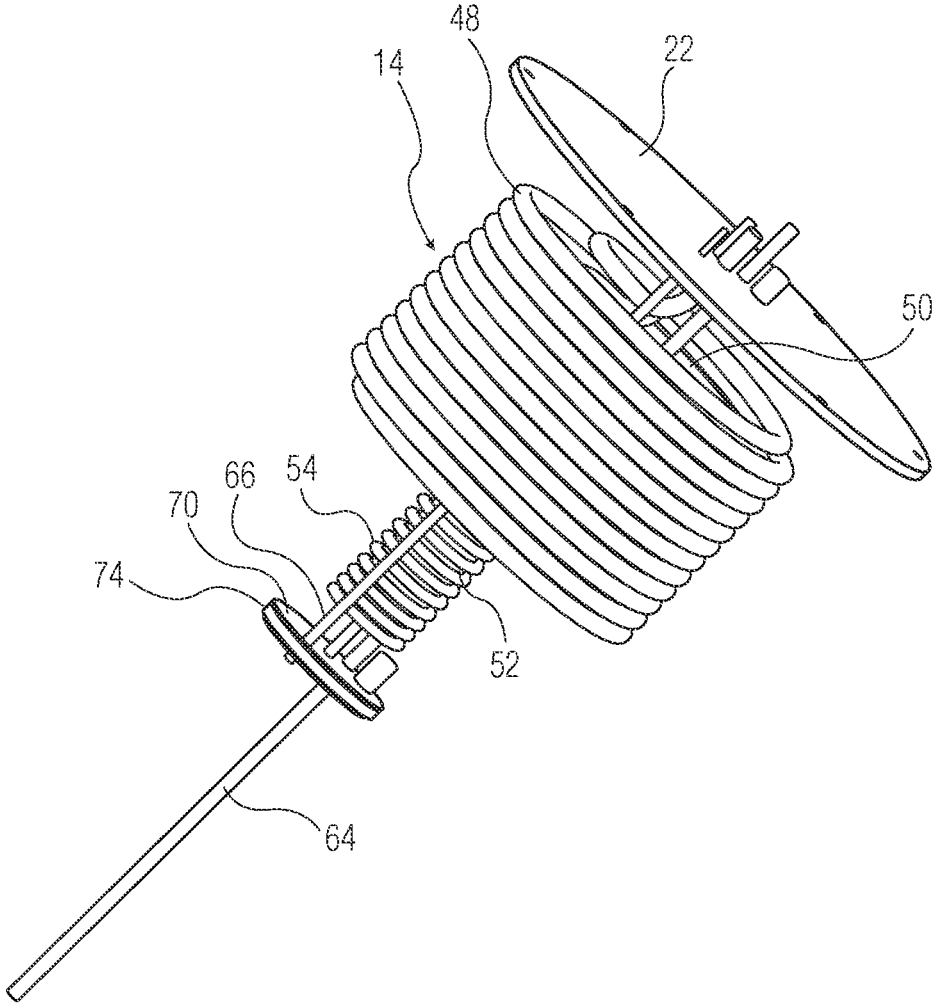
FIG. 13 illustrates a heat exchange assembly formed integrally or securely with a lid of a housing that houses a Dewar system configured to liquefy a flow of fluid, and to store the liquefied fluid, in accordance with one or more embodiments of the invention.
Figure 14:
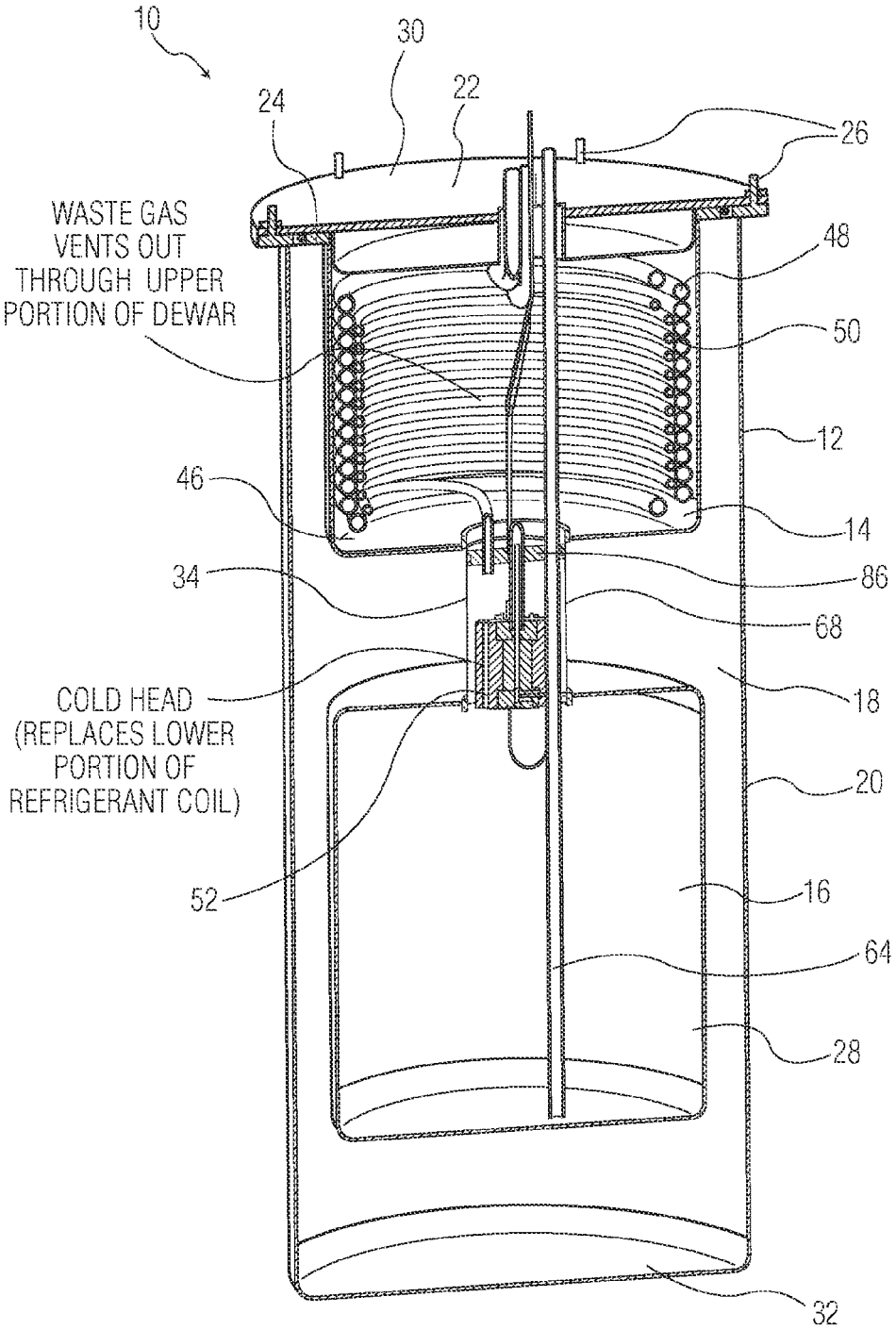
FIG. 14 illustrates a Dewar system configured to liquefy a flow of fluid, and to store the liquefied fluid, in accordance with one or more embodiments of the invention.

FIG. 13 provides a view of at heat exchange assembly 14 integrally or securely formed with second piece 22. Specifically, in the view shown in FIG. 13, decoupling second piece 22 from first piece 20 to open housing 12 has resulted in heat exchange assembly 14 being removed from housing 12. As can be seen in FIG. 13, in addition to heat exchange assembly 14, in one embodiment second piece 22 carries at least a portion of interface assembly 34 (e.g., lip 80).

FIGS. 14-17 illustrate one or more embodiments of Dewar system 10 in which heat exchange assembly 14 is positioned on top of storage assembly 16 in the manner shown in FIGS. 1 and 2. In the one or more embodiments illustrated in FIGS. 14-17, heat exchange assembly 14 does not include a secondary refrigerant conduit or condensing chamber. Instead, fluid expelled from fluid conduit 50 is provided into a chamber formed by reservoir neck 68. As can be seen, for example, in the magnified view of FIG. 15, cold head 52 is also disposed in this chamber.

Cold head 52 is formed having a cross-section that tends to enhance the amount of surface area on cold head 52. As fluid enters the chamber formed by reservoir neck 68 from fluid conduit 50, fluid that is still in the gaseous state comes into contact with cold head 52. This causes the fluid to condense, and then to flow down into storage reservoir 28 for storage.

Figure 15:
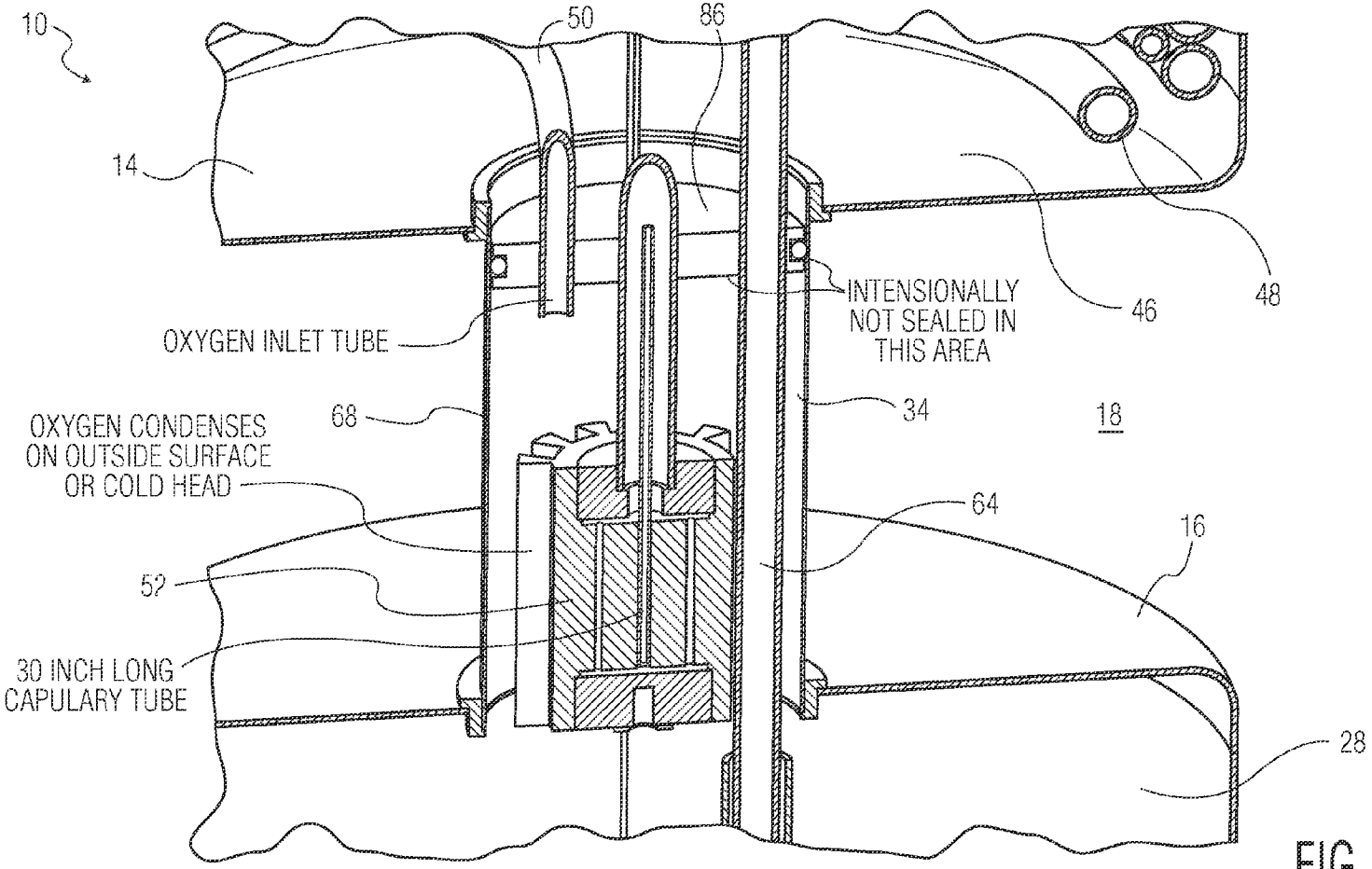
FIG. 15 illustrates a an interface assembly in a Dewar system configured to liquefy a flow of fluid, and to store the liquefied fluid, according to one or more embodiments of the invention.
Figure 16:
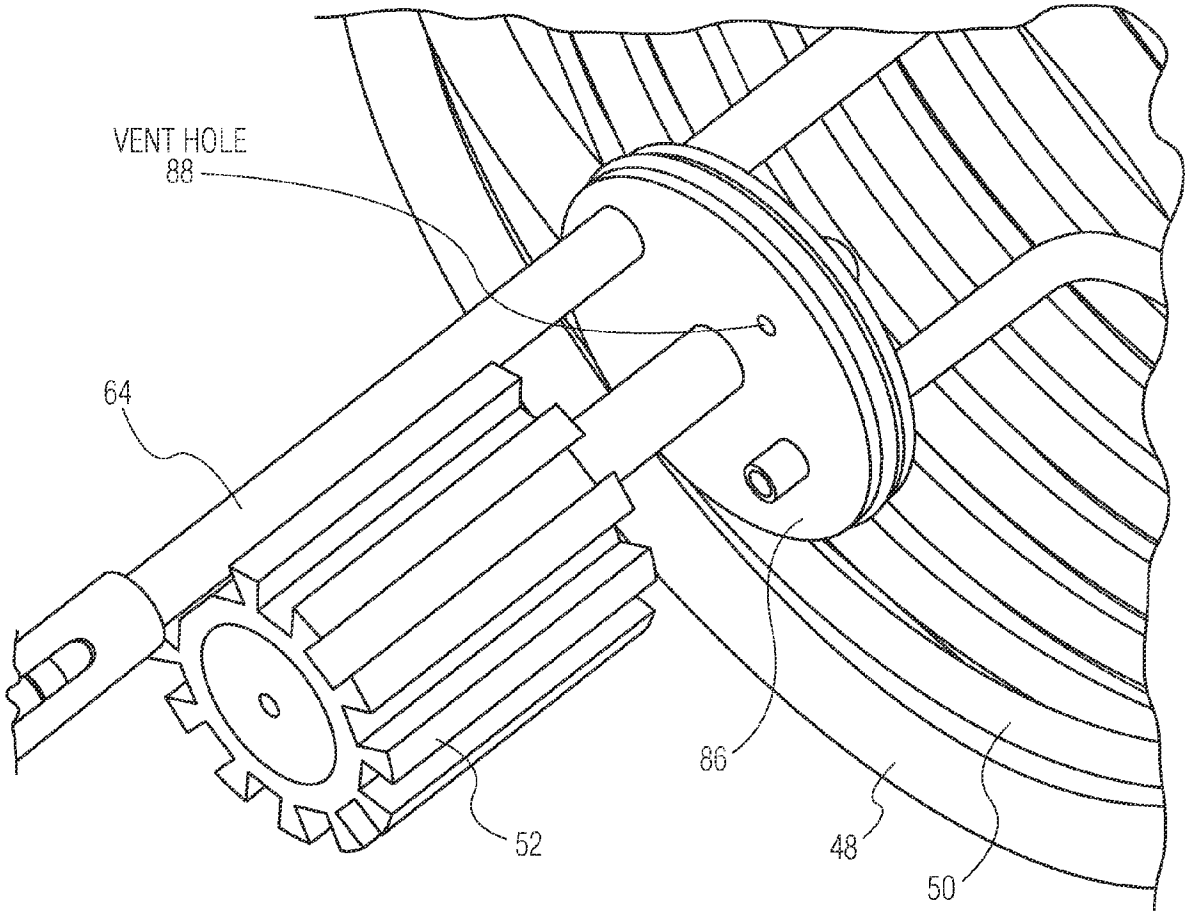
FIG. 16 illustrates a cold head from a heat exchange assembly configured to liquefy a fluid, in accordance with one or more embodiments of the invention.

As can be seen in FIG. 15, the chamber within reservoir neck 68 is formed in part by a lid 86. Although lid 86 cooperates with reservoir neck 68 to form the chamber, lid 86 does not seal the chamber from heat exchange assembly 14. Instead, fluid within storage reservoir 28 in the gaseous state may escape from storage reservoir 28 into heat exchange assembly 14 through and/or around lid 86. For example, the engagement between lid 86 and reservoir neck 68 may not be sealed, and/or lid 86 may form a vent opening 88 shown in FIG. 16. Returning to FIG. 14, fluid that escapes from storage reservoir 28 in the gaseous state into heat exchange assembly 14 may be released from housing 12 (e.g., to atmosphere) through a fluid outlet 90.

Figure 17:
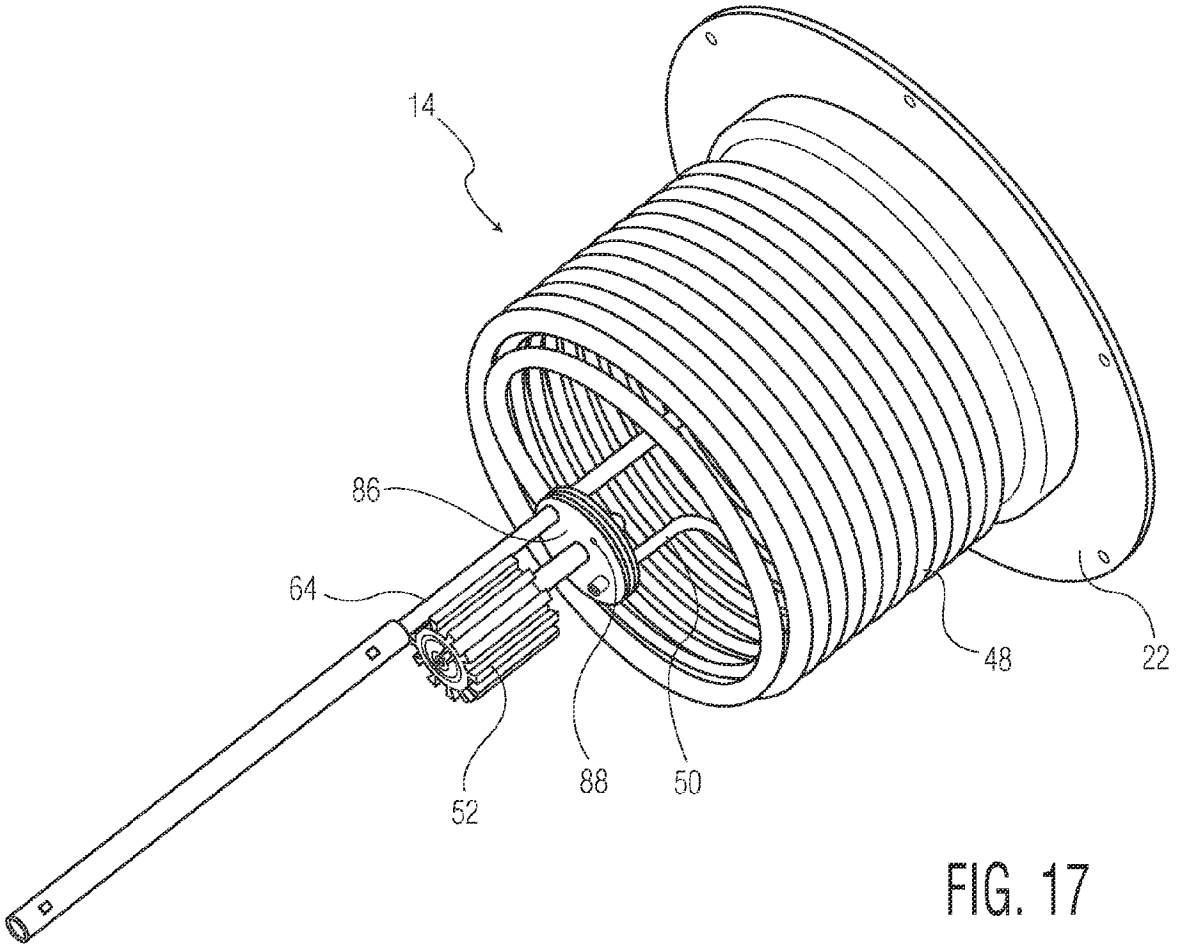
FIG. 17 illustrates a heat exchange assembly formed integrally or securely with a lid of a housing that houses a Dewar system configured to liquefy a flow of fluid, and to store the liquefied fluid, in accordance with one or more embodiments of the invention.
Figure 18:
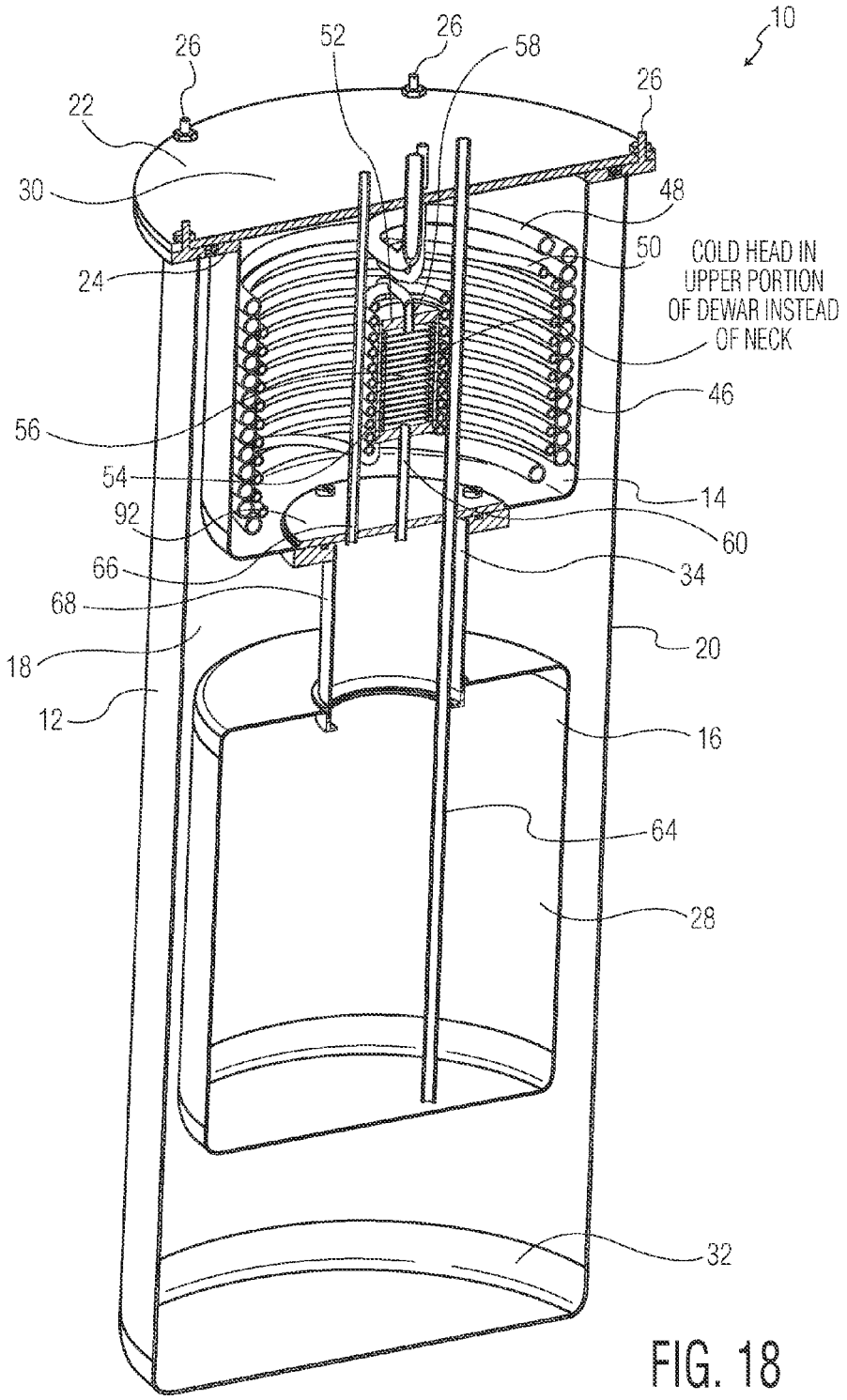
FIG. 18 illustrates a Dewar system configured to liquefy a flow of fluid, and to store the liquefied fluid, in accordance with one or more embodiments of the invention.

FIG. 17 provides a view of heat exchange assembly 14 and a portion of interface assembly 34 (e.g., lid 86) detached from the rest of Dewar system 10 by virtue of its integral and/or secure formation with second piece 22. As can be seen in FIG. 17, in one embodiment illustrated in FIGS. 14-17, decoupling second piece 22 from first piece 20 enables heat exchange assembly 14 (complete with cold head 52) and lid 86 to be removed from cavity 18 of housing 12.

FIGS. 18-21 illustrate one or more embodiments of Dewar system 10 in which heat exchange assembly 14 is positioned on top of storage assembly 16 in the manner shown in FIGS. 1 and 2. In one embodiment illustrated in FIGS. 18-21, cold head 52 is not located within reservoir neck 68, but instead is positioned within housing 46 with the rest of heat exchange assembly 14.

Figure 19:
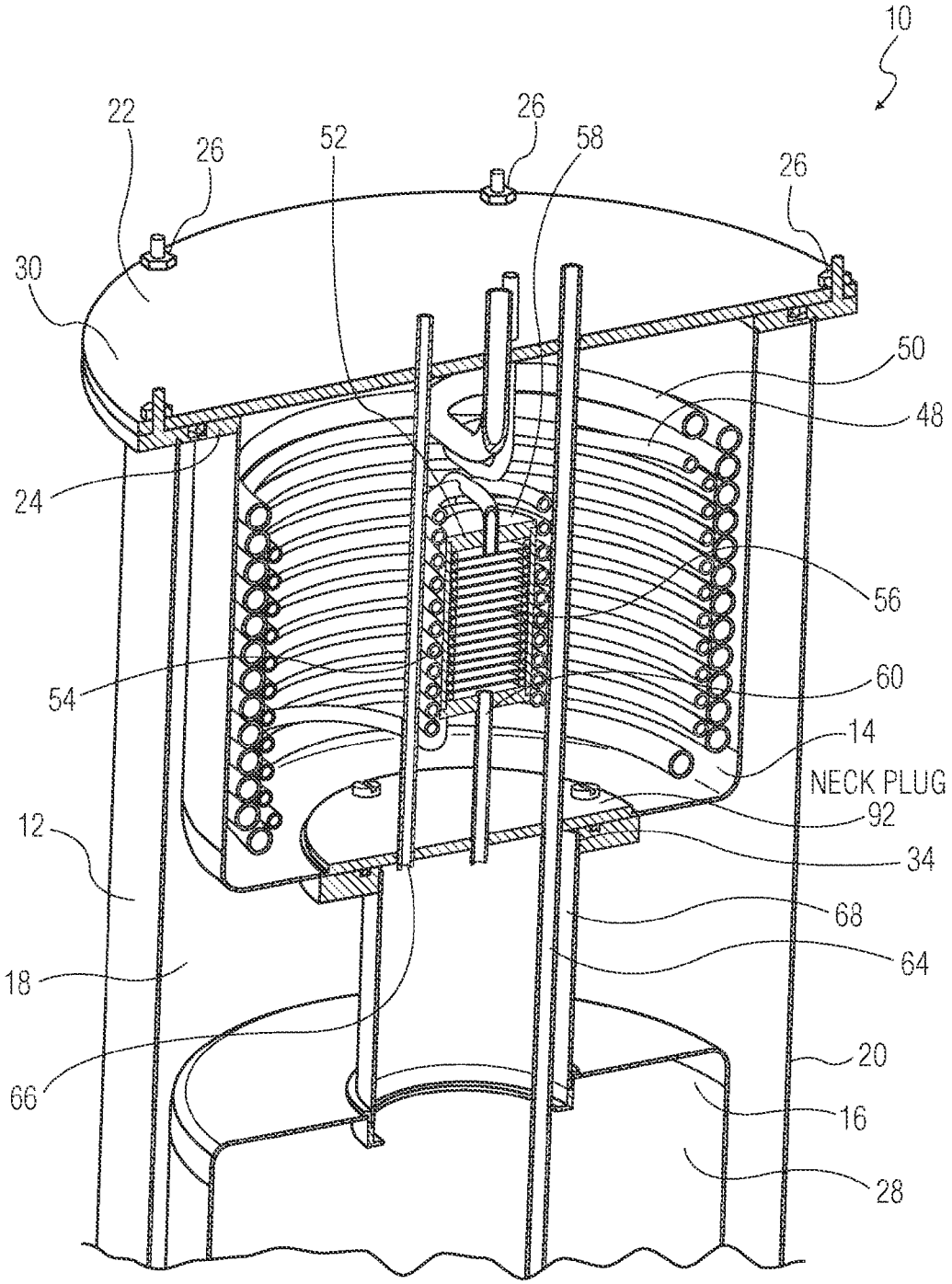
FIG. 19 illustrates a heat exchange assembly and an interface assembly in a Dewar system configured to liquefy a flow of fluid, and to store the liquefied fluid, according to one or more embodiments of the invention.
Figure 20:
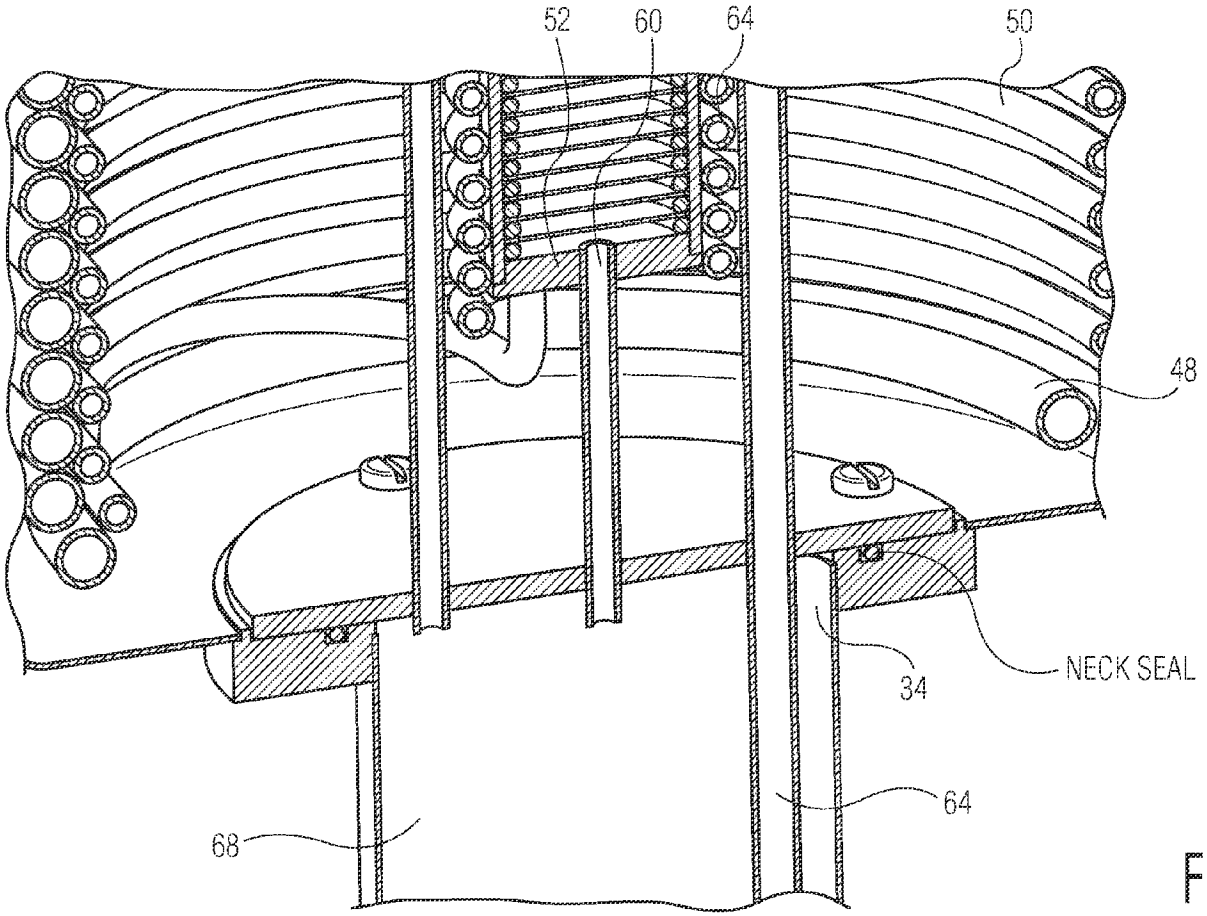
FIG. 20 illustrates a seal between an interface assembly and a heat exchange assembly in a Dewar system configured to liquefy a flow of fluid, and to store the liquefied fluid, in accordance with one or more embodiments of the invention.
Figure 21:
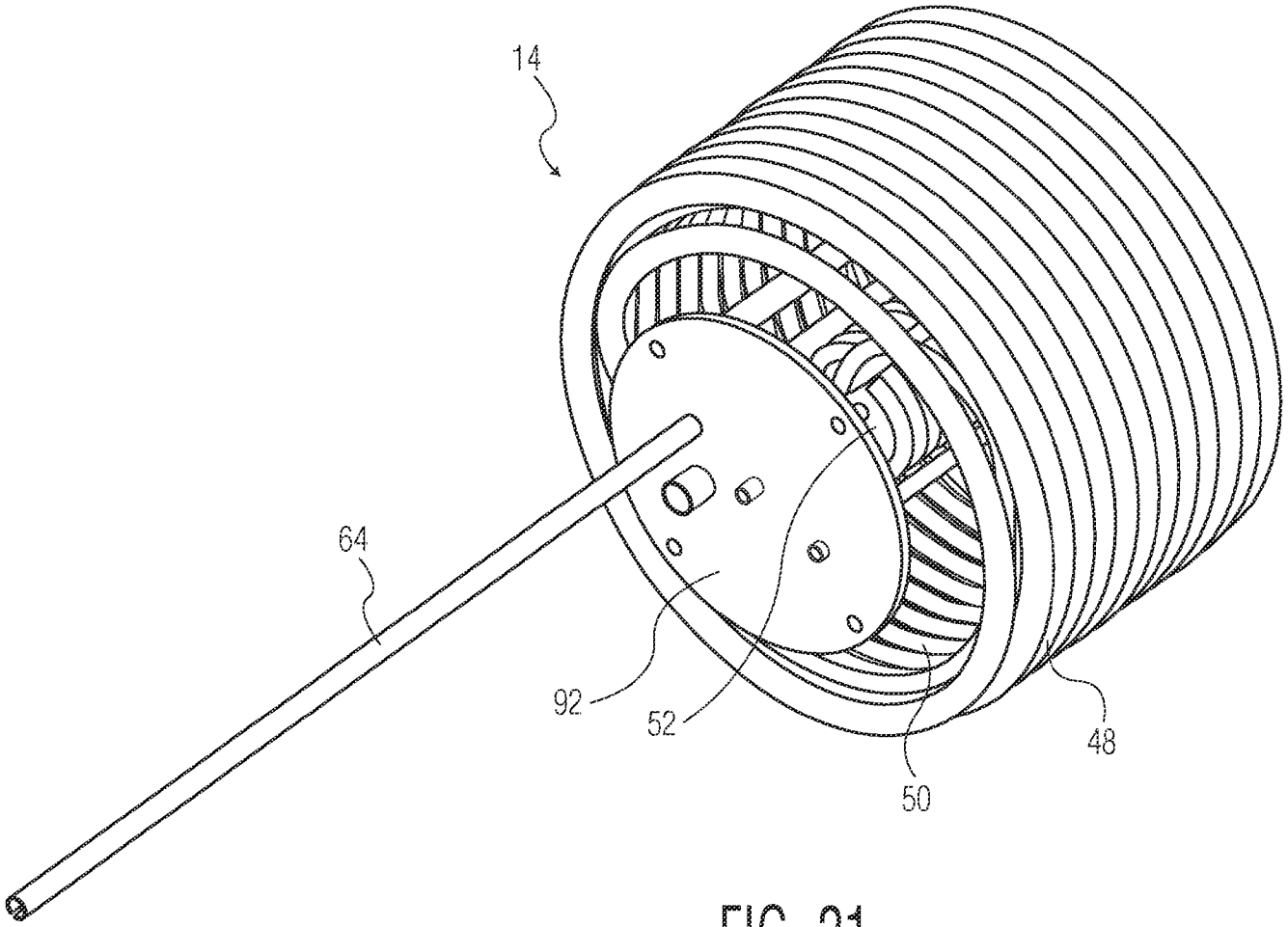
FIG. 21 illustrates a heat exchange assembly formed integrally or securely with a lid of a housing that houses a Dewar system configured to liquefy a flow of fluid, and to store the liquefied fluid, in accordance with one or more embodiments of the invention.

As can be seen in particular in FIGS. 19 and 20, interface assembly 34 includes a lid 92 that seals reservoir neck 68 and storage reservoir 28 from housing 46. As is shown in FIG. 21, when second piece 22 of housing 12 is decoupled from first piece 20 of housing 12, lid 92 is removed from cavity 18 with heat exchange assembly 14.

Figure 22:
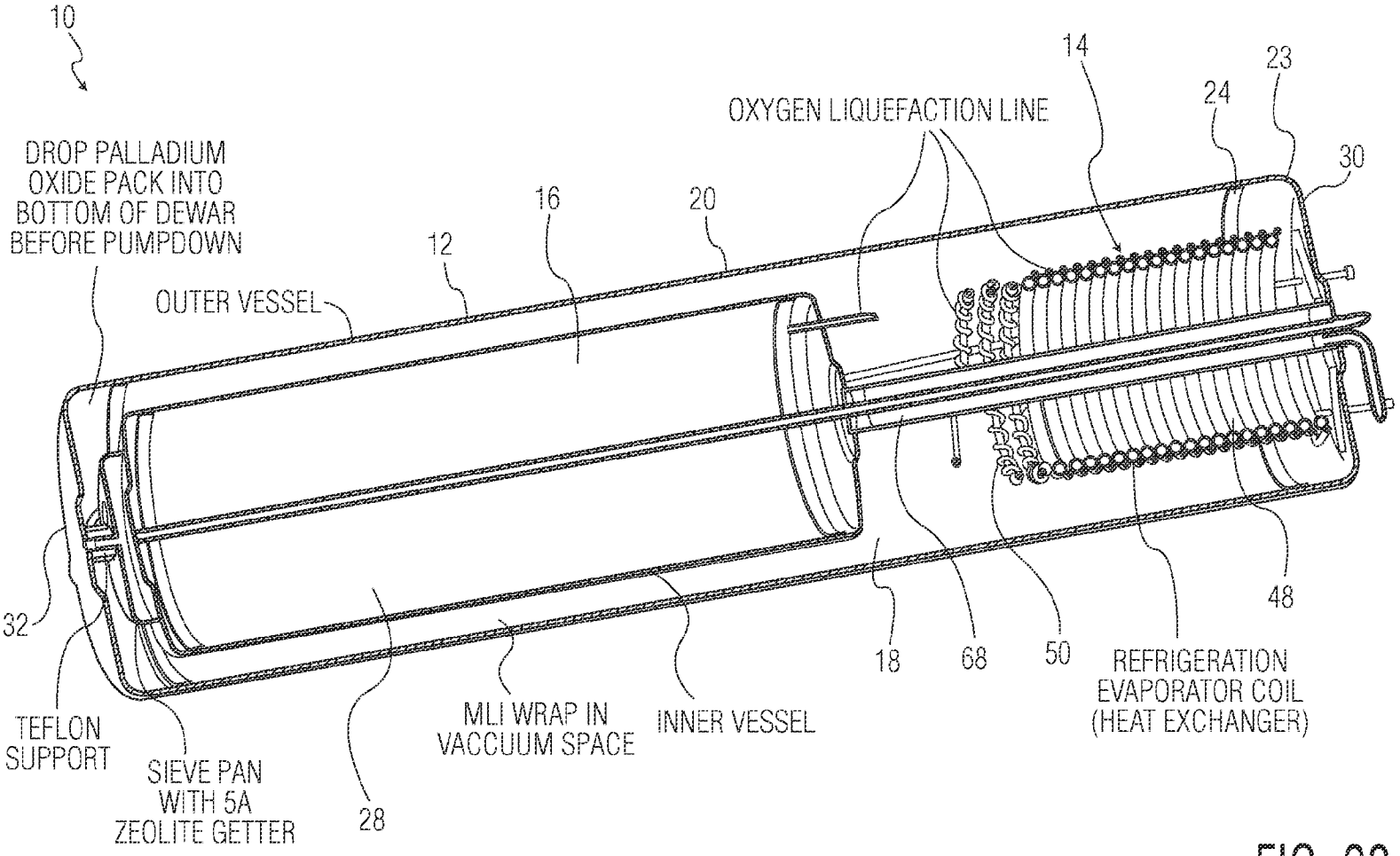
FIG. 22 illustrates a Dewar system configured to liquefy a flow of fluid, and to store the liquefied fluid, in accordance with one or more embodiments of the invention.

FIG. 22 illustrates one or more embodiments of Dewar system 10 in which heat exchange assembly 14 is positioned on top of storage assembly 16 in the manner shown in FIGS. 1 and 2. However, in one embodiment illustrated in FIG. 22, reservoir neck 68 extends all the way through housing 12 from storage reservoir 28 to the opening in cavity 18, and is configured to engage second piece 22 of housing 12 when Dewar system 10 is fully assembled. As such, if the interior of housing 12 is pumped down to form a vacuum therein, the vacuum space surrounds storage reservoir 28 and reservoir neck 68.

In one embodiment illustrated in FIG. 22, heat exchange assembly 14 is not housed by housing 46, but instead is configured to surround at least a portion of reservoir neck 68 in the vacuum space inside of housing 12. For example, refrigerant conduit 48, and fluid conduit 50 may be coiled about reservoir neck 68 in the vacuum space formed within housing 12. In some implementations, fluid conduit 50 may be wrapped around refrigerant conduit 48. This may enhance the amount of heat that is removed from fluid within fluid conduit 50 by refrigerant flowing through refrigerant conduit 48.

In one embodiment illustrated in FIG. 22, heat exchange assembly 14 is formed integrally and/or securely within second piece 22 of housing 12. As such, if housing 12 is disassembled by removing second piece 22 from first piece 20, heat exchange assembly 14 will be withdrawn from cavity 18. However, this is not intended to be limiting, and in one embodiment, heat exchange assembly 14 is formed integrally or securely with first piece 20 of housing 12 such that if second piece 22 is removed from first piece 20, heat exchange assembly 14 remains seated within cavity 18.

Figure 23:
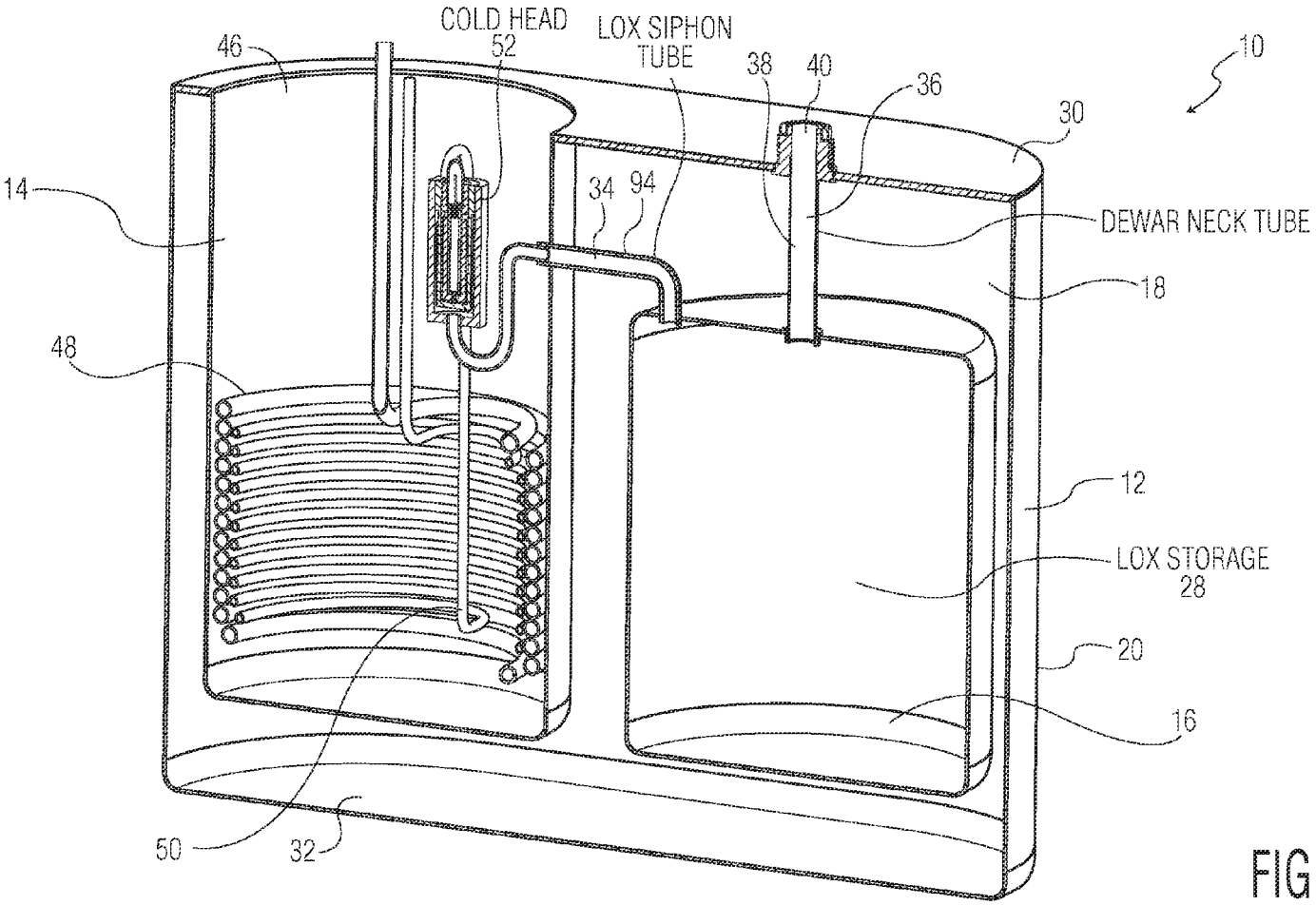
FIG. 23 illustrates a Dewar system configured to liquefy a flow of fluid, and to store the liquefied fluid, in accordance with one or more embodiments of the invention.
Figure 24:
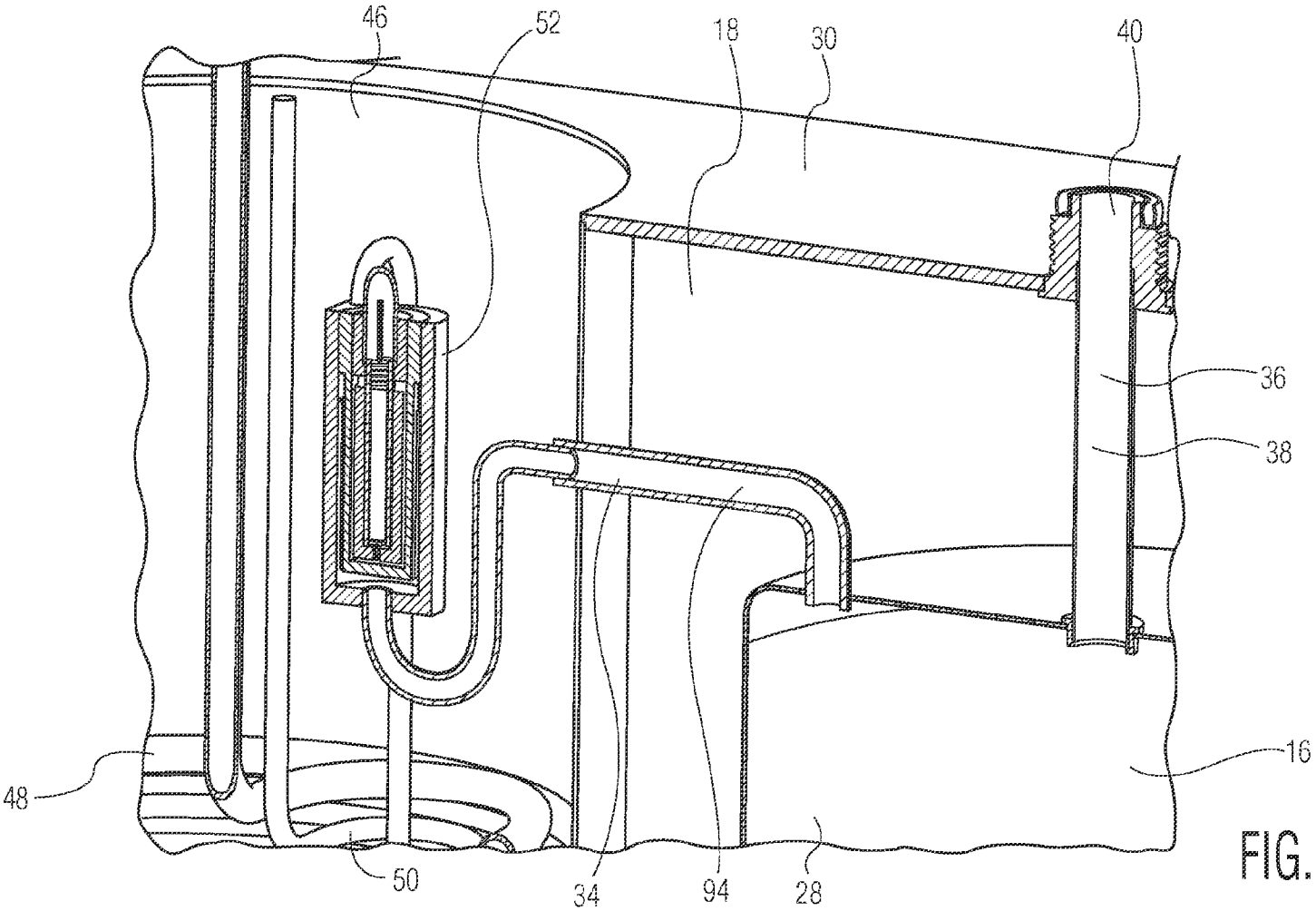
FIG. 24 illustrates an interface assembly in a Dewar system configured to liquefy a flow of fluid, and to store the liquefied fluid, according to one or more embodiments of the invention.

FIGS. 23 and 24 illustrate one or more embodiments of Dewar system 10 in which heat exchange assembly 14 and storage assembly 16 are positioned side by side within housing 12 in the manner shown in FIGS. 3 and 4. In one embodiment, fluid is received into heat exchange assembly 14 by fluid conduit 50, and heat is removed from the fluid within fluid conduit 50 in much the same manner as was described above with respect to FIGS. 9-13. The fluid is then dispensed into cold head 52, which itself is disposed in housing 46 with the rest of heat exchange assembly 14.

In one embodiment illustrated in FIGS. 23 and 24, upon being liquefied by heat exchange assembly 14, fluid is provided to storage reservoir 28 from cold head 52 by interface assembly 34. In this embodiment, interface assembly 34 includes a siphon conduit 94 that communicates cold head 52 with storage reservoir 28. The siphon conduit 94 may be formed with a releasable two-piece construction such that heat exchange assembly 14 can be selectively decoupled from storage assembly 16 for removal from housing 12. Or, siphon conduit 94 may be formed as a single, or at least substantially non-releasable, conduit that runs from an outlet of cold head 52 to an inlet of storage reservoir 28.

As can be seen in particular in the magnified view of FIG. 24, between housing 46 and storage reservoir 28, the thickness of the material forming siphon conduit 94 may be greater than the thickness of the material within heat exchange assembly 14. This may insulate the flow path formed by siphon conduit 94, and/or may enable siphon conduit 94 to maintain its structural integrity in an embodiment in which the interior of housing 12 is under vacuum.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A system configured to liquefy a fluid, and to store the liquefied fluid, the system comprising:

a housing configured to substantially seal the interior of the housing from atmosphere comprising a first piece and a second piece, wherein the first piece and the second piece are configured to be selectably coupled together to substantially seal the interior of the housing from atmosphere, wherein the second piece of the housing forms a cavity having an opening formed by a rim of the second piece of the housing, and wherein the first piece of the housing is a lid that is selectably coupled to the rim of the second piece of the housing to substantially seal the cavity formed by the first piece of the housing from atmosphere;

a heat exchange assembly disposed within the housing, the heat exchange assembly comprising a fluid conduit that passes from inside the housing to outside the housing, the fluid conduit being configured to receive a flow of fluid in a gaseous state from a fluid flow generator located outside the housing, the heat exchange assembly being configured to liquefy the flow of fluid received into the heat exchange assembly via the fluid conduit, a cold head disposed in the heat exchange assembly, the cold head in fluid communication with the fluid conduit, the cold head configured to reduce the temperature of the flow of fluid to liquefy fluid not liquefied by the heat exchange assembly, wherein the heat exchange assembly and the cold head are formed integrally or securely with (i) one another and (ii) the first piece of the housing such that removal of the first piece of the housing causes the heat exchange assembly and the cold head to be removed from the housing, and a fluid storage assembly disposed within the housing, the fluid storage assembly being in fluid communication with the heat exchange assembly, the fluid storage assembly being configured to store fluid that has been liquefied by the heat exchange assembly, and wherein the fluid storage assembly is formed integrally or securely with the second piece of the housing, wherein the heat exchange assembly and the cold head formed integrally or securely with the first piece of the housing and the fluid storage assembly formed integrally or securely with the second piece of the housing are positioned side by side within the housing.

2. The system of claim 1, wherein the storage assembly comprises a reservoir neck that extends from a storage reservoir through the housing to enable liquefied fluid to be released from the storage reservoir, wherein a vacuum space is formed between the housing and the storage assembly, and wherein the heat exchange assembly is disposed in the vacuum space.

3. The system of claim 1, wherein the fluid is oxygen.

4. A method of liquefying a fluid, and storing the liquefied fluid, the method comprising:

substantially sealing a cavity from atmosphere;

receiving a flow of fluid in a gaseous state into the cavity from outside the cavity through a fluid conduit, wherein the flow of fluid is received into the cavity in a gaseous state;

liquefying the flow of fluid received into the cavity via the fluid conduit;

reducing the temperature of the flow of fluid to liquefy fluid not previously liquefied;

directing the liquefied fluid into a reservoir disposed within the cavity; and storing the liquefied fluid within the reservoir, wherein:

substantially sealing the cavity from atmosphere is performed by a first piece of a housing selectably coupled to a second piece of the housing to substantially seal the cavity, which is formed in the interior of the housing, from atmosphere, a heat exchange assembly that performs the liquefaction of the flow of fluid and a cold head, disposed in the heat exchange assembly and in fluid communication with the fluid conduit, that performs the temperature reduction of the flow of fluid are formed integrally or securely with (i) one another and (ii) the first piece of the housing such that removal of the first piece of the housing causes the heat exchange assembly and the cold head to be removed from the housing, the reservoir is formed integrally or securely with the second piece of the housing, the second piece of the housing forms the cavity such that the cavity has an opening formed by a rim of the second piece of the housing, the first piece of the housing is a lid formed such that selectably coupling the lid to the rim of the second piece of the housing substantially seals the cavity formed by the first piece of the housing from atmosphere; and the heat exchange assembly and the cold head formed integrally or securely with the first piece of the housing and the fluid storage assembly formed integrally or securely with the second piece of the housing are positioned side by side within the housing.

5. The method of claim 4, wherein a heat exchange assembly that performs the liquefaction of the flow of fluid is disposed within a portion of the cavity this is under vacuum, and is external to the reservoir.

6. The method of claim 4, wherein the fluid is oxygen.

7. A system configured to liquefy a fluid, and to store the liquefied fluid, the system comprising:

means for substantially sealing a cavity from atmosphere comprising a first piece and a second piece, the first piece and second piece being selectably coupled to seal the cavity from atmosphere;

means for receiving a flow of fluid in a gaseous state into the cavity from outside the cavity, wherein the flow of fluid is received into the cavity by the means for receiving in a gaseous state;

means for liquefying the flow of fluid received into the cavity, wherein the means for liquefying the flow of fluid is disposed within the cavity;

means for reducing the temperature of the flow of fluid, the means for reducing the temperature of the flow of fluid being configured to liquefy fluid not liquefied by the means for liquefying the flow of fluid, wherein the means for reducing the temperature of the flow of fluid is disposed in the means for liquefying the flow of fluid, wherein the means for reducing the temperature of the flow of fluid is in fluid communication with the means for receiving the flow of fluid, and wherein the means for liquefying the flow of fluid and the means for reducing the temperature of the flow of fluid are formed integrally or securely with (i) one another and (ii) the first piece of the means for substantially sealing such that removal of the first piece of the means for substantially sealing causes the means for liquefying the flow of fluid and the means for reducing the temperature of the flow of fluid to be removed from the means for substantially sealing; and means storing the liquefied fluid within the cavity that is formed integrally or securely with the second piece of the means for substantially sealing, wherein the second piece of the means for substantially sealing forms the cavity such that the cavity has an opening formed by a rim of the second piece of the means for substantially sealing, and wherein the first piece of the means for substantially sealing is a lid formed such that selectably coupling the lid to the rim of the second piece of the means for substantially sealing substantially seals the cavity from atmosphere, wherein the means for liquefying and the means for reducing the temperature of the flow of fluid formed integrally or securely with the first piece of the means for substantially sealing and the means for storing formed integrally or securely with the second piece of the means for substantially sealing are positioned side by side within the means for substantially sealing.

8. The system of claim 7, wherein the portion of the cavity that is external to the means for storing is under vacuum, thereby creating a vacuum space, and wherein the means for liquefying is disposed in the vacuum space.

9. The system of claim 7, wherein the fluid is oxygen.

10. The system of claim 1, wherein the cold head comprises a plurality of screen meshes separated by spacers.

11. The system of claim 10, wherein the cold head is in fluid communication with the fluid storage assembly via a siphon conduit, the siphon conduit having a conduit wall thickness greater than the fluid conduit wall thickness.

12. The method of claim 4, wherein the cold head comprises a plurality of screen meshes separated by spacers.

13. The method of claim 12, wherein the cold head is in fluid communication with the fluid storage assembly via a siphon conduit, the siphon conduit having a conduit wall thickness greater than the fluid conduit wall thickness.

14. The system of claim 7, wherein the means for reducing the temperature of the flow of fluid comprises a plurality of screen meshes separated by spacers.

15. The system of claim 14, wherein the means for reducing the temperature of the flow of fluid is in fluid communication with the means storing the liquefied fluid via a siphon conduit, the siphon conduit having a conduit wall thickness greater than the thickness of the means for receiving the flow of fluid.

* * * * *